United States Patent [19]

Hallam et al.

[11] Patent Number: 4,718,489

[45] Date of Patent: Jan. 12, 1988

[54] PRESSURE-UP/BLOWDOWN COMBUSTION - A CHANNELLED RESERVOIR RECOVERY PROCESS

[75] Inventors: Richard J. Hallam; John K. Donnelly, both of Calgary, Canada

[73] Assignee: Alberta Oil Sands Technology and Research Authority, Edmonton, Canada

[21] Appl. No.: 908,306

[22] Filed: Sep. 17, 1986

[51] Int. Cl.[4] ..... E21B 43/18; E21B 43/247

[52] U.S. Cl. ..... 166/259; 166/261; 166/263; 166/272

[58] Field of Search ..... 166/245, 259, 261, 263, 166/271, 272

[56] References Cited

U.S. PATENT DOCUMENTS

| | | | |
|---|---|---|---|
| 3,150,715 | 9/1964 | Diete | 166/261 |
| 3,332,482 | 7/1967 | Trantham | 166/263 |
| 3,411,575 | 11/1968 | Connally, Jr. | 166/271 |
| 3,434,541 | 3/1969 | Cook et al. | 166/263 |
| 3,847,219 | 11/1974 | Wang | 166/263 |
| 4,133,382 | 1/1979 | Cram et al. | 166/261 |
| 4,427,066 | 1/1984 | Cook | 166/261 |
| 4,429,744 | 2/1984 | Cook | 166/272 |
| 4,429,745 | 2/1984 | Cook | 166/261 |
| 4,593,759 | 6/1986 | Penick | 166/272 |

FOREIGN PATENT DOCUMENTS

| | | | |
|---|---|---|---|
| 0733808 | 5/1966 | Canada | 166/272 |
| 0864309 | 2/1971 | Canada . | |
| 0866576 | 3/1971 | Canada . | |
| 0895303 | 5/1962 | United Kingdom | 166/272 |

*Primary Examiner*—George A. Suchfield
*Assistant Examiner*—TerryLee Melius
*Attorney, Agent, or Firm*—Millen & White

[57] ABSTRACT

A cyclic process is described for recovering heavy oil from a reservoir having a network of generally linear, narrow permeable communication channels interconnecting outlying producing wells with an injection well. Except for the channels, the reservoir must be sufficiently impermeable so that pressure may be built up therein by the continued injection of oxidizing gas and propagation of a combustion front when the producers are choked or shut in. The process comprises:

(a) initiating combustion in the reservoir at the injection well;

(b) injecting oxidizing gas into the reservoir at less than fracturing pressure with the producers open, to propagate a rapid advance of the combustion front through a first channel toward a first of the producers;

(c) after heat breakthrough has been established between the injector and said first producer, and before the combustion front arrives at said producer, restricting fluid production from said producer (as by choking or shutting the well in);

(d) continuing to inject as before to induce widening of the hot first channel and rapid advance of the combustion front down a second channel toward an open second producer;

(e) restricting the second producer after gas breakthrough has been established and before the combustion front arrives at said second producer;

(f) repeating (d) and (e) for each of the other producers until all of the producers are restricted;

(g) continuing to inject as before to cause a significant pressure build-up in the channel network and surrounding reservoir, said built-up pressure being less than the fracturing pressure;

(h) substantially terminating oxidizing gas injection and injecting water into the network to cool it to a temperature below that at which significant coking occurs.

(i) opening the producers to blowdown the reservoir; and (j) repeating steps (a) to (i) at least once.

Preferably, the network of channels is provided by subjecting the wells to cyclic steam stimulation conducted at fracturing pressure, to create both on-trend and off-trend channels interconnecting a group of wells that make up the focal points of the network.

11 Claims, 37 Drawing Figures

PRESSURE-UP BLOWDOWN COMBUSTION PROCESS

ALIGNMENT OF FRACTURES FORMED IN THE FIRST CYCLE

PHASE A - 1978, WELL LOCATIONS

IDEALIZED CROSS-LINKING OF WELLS PRIOR TO IN-SITU COMBUSTION PHASE

PHASE A-1981, WELL LOCATIONS

RESERVOIR PRESSURE-INJECTION CYCLE TIME SCENARIO

RELATIVE BOTTOMHOLE WELL LOCATIONS

PHASE A: COMBUSTION CYCLE No. 100
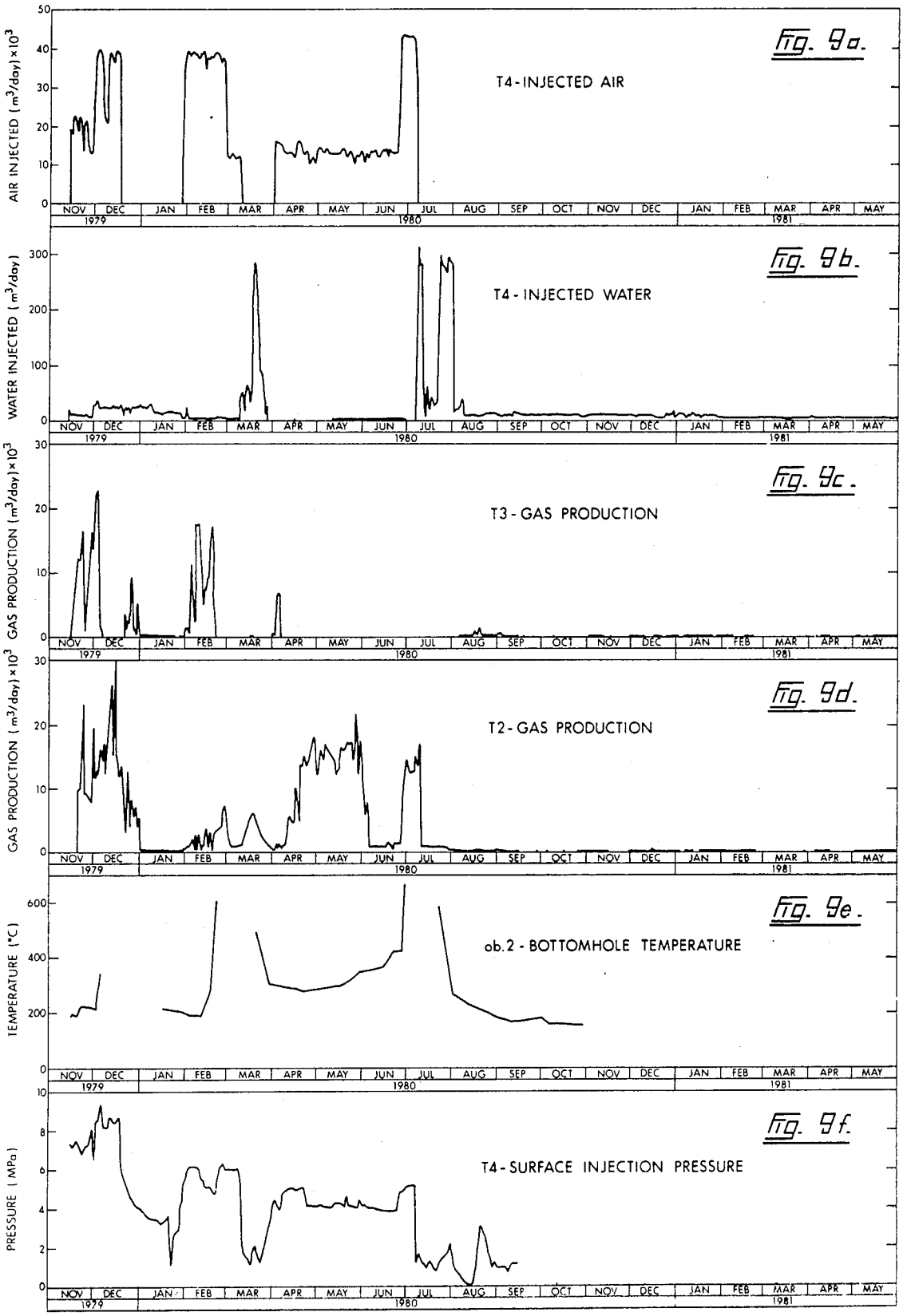

PHASE A: COMBUSTION CYCLE No. 100

T2 - WATER PRODUCTION
WATER PRODUCTION (m³/day)

T2 - OIL PRODUCTION
OIL PRODUCTION (m³/day)

T3 - OIL PRODUCTION
OIL PRODUCTION (m³/day)

T3 - WATER PRODUCTION
WATER PRODUCTION (m³/day)

T3 - BOTTOMHOLE PRESSURE
PRESSURE (MPa)

T2 - BOTTOMHOLE PRESSURE
PRESSURE (MPa)
NOV DEC JAN FEB MAR APR MAY JUN JUL AUG SEP OCT NOV DEC JAN FEB MAR APR MAY
1979
1980
1981

PHASE A: COMBUSTION CYCLE No. 101

T4 - INJECTED AIR
AIR INJECTED ($m^3$/day) x $10^2$

T4 - INJECTED WATER
WATER INJECTED ($m^3$/day)

T3 - OIL PRODUCTION
OIL PRODUCTION ($m^3$/day)

T2 - OIL PRODUCTION
OIL PRODUCTION ($m^3$/day)

T3 - BOTTOMHOLE PRESSURE
PRESSURE (MPa)

T2 - BOTTOMHOLE PRESSURE
PRESSURE (MPa)
J A S O N D J F M A M J J A S O
1981
1982

T3 - WATER PRODUCTION
WATER PRODUCTION (m3/day)

T2 - WATER PRODUCTION
WATER PRODUCTION (m3/day)

T2 - GAS PRODUCTION
GAS PRODUCTION (m3/day) ×10³ ob 2 - BOTTOMHOLE TEMPERATURE
TEMPERATURE (°C)

ob.1 - BOTTOMHOLE TEMPERATURE
TEMPERATURE (°C)

T4 - TOPHOLE PRESSURE ob.11 - BOTTOMHOLE PRESSURE
J A S O N D J F M A M J J A S O
1981
1982

PHASE A - MAIN PATTERN WELL LOCATIONS

PHASE A - MAIN PATTERN COMBUSTION PERFORMANCE
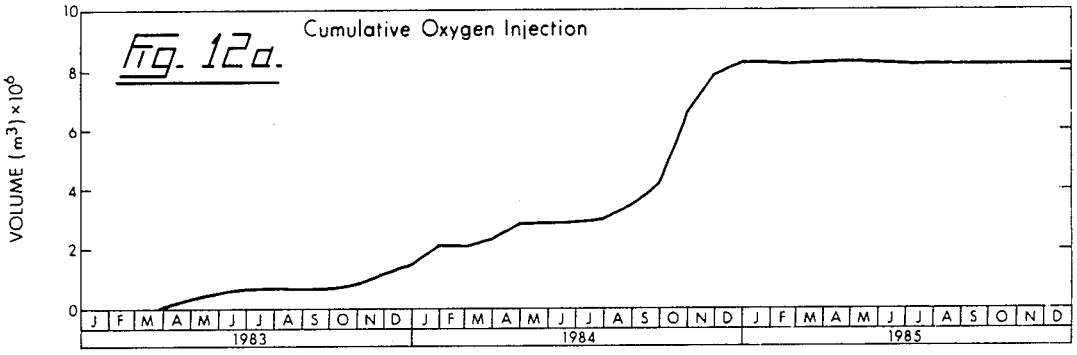
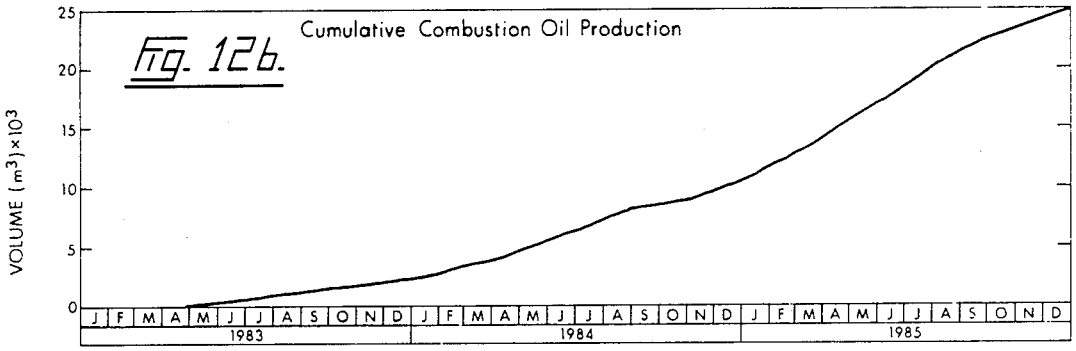
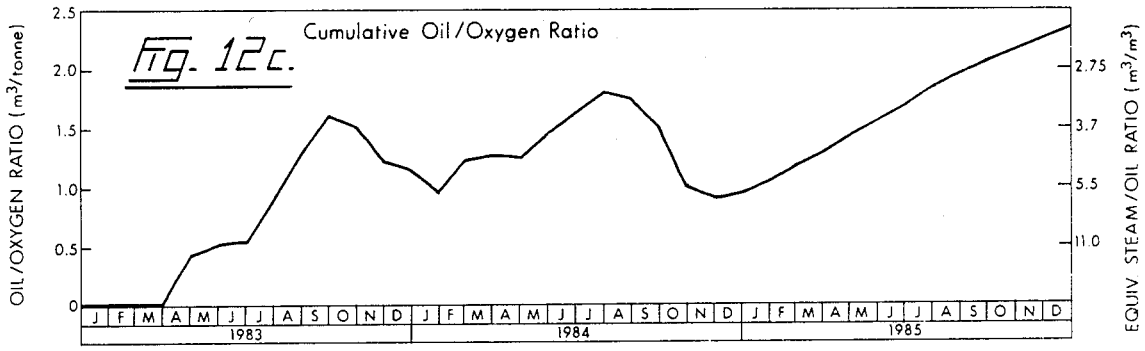

PRESSURE-UP/BLOWDOWN COMBUSTION - A CHANNELLED RESERVOIR RECOVERY PROCESS

FIELD OF THE INVENTION

This invention relates to an oil recovery process involving creation of a network of fluid communication channels interconnecting a pattern of wells followed by a forward combustion/sequential throttling of producers/pressure-up/blowdown sequence that is repeated cyclically.

BACKGROUND OF THE INVENTION

In-Situ Combustion in General

The present invention relates to the recovery of petroleum from an underground reservoir using an in-situ forward combustion process.

'Forward combustion' is a term applied to a broad class of oilfield recovery processes in which heat is generated within the reservoir by igniting the formation oil and then propagating the combustion front, by continuous injection of an oxidizing agent such as air through an injection well ('injector'), toward an outlying production well ('producer').

Conventional forward combustion is a flooding process. The displacement can occur radially from the injector toward the surrounding producers. This is typically done with the wells arranged in spot patterns, for example in 5 or 7 well spot patterns in which the producers surround the injector. Alternatively, the displacement can be practised using a line drive pattern. In this pattern, the injectors and producers are arranged in alternating rows.

In these processes, the rate of combustion front advance is restricted by the oil and water in place ahead of the front. Such frontal velocities are usually low, typically in the order of 0.03 to 0.06 meters per day.

Once combustion has been initiated at the injection well, newly injected air first encounters hot sand or rock which has already been burned through. The air becomes heated by the hot sand or rock as it advances therethrough, while at the same time the latter is cooled. The hot air passes into the relatively narrow combustion zone, wherein it reacts with coke left from thermal cracking of in-place oil. In the zone just ahead of the combustion front, combustion gases, connate water and cracked volatile hydrocarbons evaporate and move ahead and form a steam bank, following which the steam and hydrocarbons condense to form a water bank and an oil bank. Beyond the oil bank, the gases flow through substantially unheated or cold reservoir toward the producers. The various zones involved in such a process are shown schematically in FIG. 1.

A known procedure for improving the thermal efficiency of a combustion process is to inject water together with the air or in alternating slugs. The water scavenges heat left in the burned out zone, is converted to steam, and transports heat through and ahead of the combustion front to provide a more efficient process.

Another known modification for combustion processes involves using oxygen-enriched air or pure oxygen instead of air as the oxidizing gas.

Channelling

Channelling has long been a problem in the in-situ combustion art. Several projects have been prematurely terminated because of the rapid advance of the combustion front through directional permeability or high permeability streaks, fractures and oil-depleted portions of the reservoir (said streaks, fractures and oil-depleted portions being hereinafter collectively referred to as "channels"). The injected air and the associated combustion front tend to move only through these channels - this narrowly focussed movement is referred to as "channelling".

Problems that can arise from channelling include:

(1) premature hot water/steam bank breakthrough at the producer (said breakthrough being hereinafter referred to as "heat breakthrough"). The temperature accompanying the heat breakthrough is typically 150°-250° C. The fluids reaching the producer on this occurrence can combine with accompanying gases ($CO_2$, $H_2S$) to cause serious corrosion of the well equipment. Also, early scale deposition around the wellbore can interfere with production;

(2) premature combustion front breakthrough at the producer. This breakthrough is characterized by high temperature (typically 450°-1200° C.) that may cause structural damage to the well; and (3) oxygen breakthrough at the producer. This can result in severe corrosion and possible damage from a gas explosion.

When the heat or combustion front breakthroughs occur, it is conventional practice to shut in or abandon the producer well so affected, even though only a small fraction of the recoverable oil may have been produced.

Pilot Project Leading Up To The Present Invention

The present invention was developed in connection with a pilot field project having wells completed in the Clearwater Formation reservoir in the Wolf Lake region of Alberta. While the process is not limited to use in the Wolf Lake reservoir, the description following below will be specific to that project.

The Wolf Lake reservoir is an unconsolidated sand formation containing heavy oil. It typically has a net pay thickness of 23 m , a gross pay thickness of 34 m , a porosity of 30%, an oil saturation of 64%, a temperature of 15° C., a pressure of 2700 kPa, and a permeability of 1-3 darcies. The oil (or bitumen) has a density of 986 kg/m$^3$ (11° API) and a viscosity of 100,000 cp at reservoir conditions. The fluid mobility at these conditions is extremely low, of the order of 0.05-0.1 millidarcies per centipoise.

From the foregoing facts, it was evident that the oil could not be produced by primary methods as it was too viscous. There was therefore a need to heat the oil in situ to reduce its viscosity and render it producible.

A study conducted prior to start-up of the pilot project had concluded that:

- oil could be recovered by cyclic steaming at good initial production rates, but percent recovery would be low;
- steam flooding would be uneconomic; and
- in-situ combustion offered the possibilities of high recovery and good thermal efficiency, but it was as yet untried in the reservoir.

Applicant decided to test a combination of cyclic steam stimulation ("huff and puff") followed by a combustion process.

When applicant first considered how to complete and operate the wells at the pilot field project, it chose to try the following approach.

(1) to drill a main pattern of wells in four 5-spot patterns and a test pattern having two wells in a row. The wells in the test pattern were to be more closely spaced than those in the main pattern, so that trends and results in the former could be used to advantage in the latter;

(2) the rows in both the main pattern and the test pattern were to extend in a NE-SW direction. The well patterns were rotated to the 45° angle in anticipation that the reservoir might have to be fractured to create injectivity. Another project in the area had to fracture the reservoir to achieve reasonable injectivity and the fractures were found to extend in the NE-SW direction. That other project however had oil saturations in the order of 80% - it was hoped that applicant's reservoir, with a water saturation of 35%, would have good injectivity below fracture pressure;

(3) to practise cyclic steam stimulation in the test pattern for 1 year and in the main pattern for 3 years;

(4) to convert 1 well in the test pattern to an air injector, at the end of the cyclic steam stimulation phase, and to initiate a combustion flood toward the adjacent producer. This would be done to obtain early combustion experience prior to converting the main pattern to combustion; and (5) then to convert the four central wells of the 5-spots in the main pattern to air injectors, while continuing to cyclic steam the remaining wells in the 5-spots. Then, 1 year later, to initiate a forward combustion flood from the central injectors to the outlying producers. This was intended to take advantage of the oil-depleted zones, created during cyclic steam stimulation, to permit easy air injection and the development of a wide deep radial combustion flood.

When the pilot field project was initiated, the following observations were made:

(1) water injectivity tests showed that fluid mobility in the reservoir was lower than anticipated;

(2) vertical fracturing was required to inject at acceptable rates and, when done, generally linear, narrow communication channels were developed which extended between on-trend (NE-SW) aligned wells;

(3) that after several cyclic steam stimulations, off-trend fracturing began to occur to interconnect wells in adjacent rows, indicating that the tectonic stress regime in the reservoir was being modified by the treatment the reservoir was undergoing; and (4) that when a combustion flood was initiated, the combustion front advanced at a high rate (2.5–3.5 meters/day) from the injector to a producer down a communication channel developed during the cyclic steam stimulation phase . This then required that the producer had to be protected by injecting water through it, after only a few days of combustion otherwise the well would have been damaged.

At this point, it became clear that it was not going to be possible to obtain a combustion sweep moving slowly and with good recovery efficiency through the largest part of the reservoir. The hot inter-well communication channels, developed by high pressure cyclic steaming, were narrow. Due to higher water and gas saturations in the channels and the mobility of the hot fluid contained therein, newly injected fluid would move readily through them because the banking of oil and water did not occur to inhibit fluid flow. Thus the combustion front would arrive in a very short time span at the producers; as previously stated, according to conventional wisdom this was highly undesirable.

Thus there was a need for a new and different strategy and process. Out of this background, the present invention was developed.

Prior art patents of interest are Canadian patents 866,576 (Hujsak) and 864,309 (Cook and Talash).

SUMMARY OF THE INVENTION

The present process finds application in a heavy oil reservoir having an injection well and a plurality of adjacent production wells completed therein. A network of generally linear, narrow, permeable fluid communication channels extends through the reservoir and interconnects the wells. Except for the channels, the reservoir is resistive to fluid flow. That is to say, the permeability to gas of the oil-containing portion of the reservoir is low, so that if the producers at the ends of the channels are restricted (by choking them or closing them in), then a localized pressure build-up in that portion of the reservoir near to the channels will take place if gas injection is continued.

With the foregoing setting in mind, the process comprises initiating forward combustion at the injector and injecting oxidizing gas, to propagate the combustion front through at least one channel at a high rate of advance. Preferably, we seek to maintain a rate of advance of the order of at least a meter/day—as compared to conventional advance rates of the order of hundredths of meters/day. Most preferably, we seek to maintain a rate of about 2–4 meters/day. The oxidizing gas injected comprises air, oxygen-enriched air, or oxygen. Preferably, water is also injected, either with the oxidizing gas or in alternating slugs. Injection is carried out without exceeding the fracture pressure for the reservoir and the producers are left open (that is, the producer's fluid production is not significantly restricted).

Forward combustion is practised in accordance with the foregoing until at least gas breakthrough is established between the injector and a first of the producers. Preferably, forward combustion is practised as aforesaid until there is indication that heat breakthrough has occurred at said first producer.

The first producer is then restricted, by choking or shutting it in. As a result of this act, the advance of the combustion front toward that producer is essentially stalled, thereby protecting the well against damage by the combustion front.

"Choking" the well can be achieved by:
restricting the annulus vent of the well;
restricting the tubing if the well is flowing;
reducing the pumping rate; or
a combination of any of the above.

In a preferred aspect of the process, when a producer is shut in due to gas or heat breakthrough, we convert said producer to low rate water or steam injection, to establish a high pressure zone adjacent the wellbore, to better protect it from the possible combustion front advance and to prevent accumulation of potentially explosive gases within the wellbore.

Once the first producer has been restricted, injection of oxidizing gas is then continued, again at less than fracture pressure, to cause the combustion front to rapidly advance through one or more of the other channels toward one or more of the remaining open producers which are in communication with the injector.

This continued injection is usually accompanied by a gradual increase in reservoir pressure and widening of the heated channels through which the combustion front has advanced or is advancing.

After gas breakthrough has been established and before the combustion front arrival at a second producer, said second producer is also then restricted to stall the approach of the combustion front toward that well and cause it to move down still another "open" channel.

This procedure of sequentially restricting the producers in this fashion is continued until at least two producers have been restricted or, preferably, all of the producers in communication with the injector have been restricted and their channels have been heated.

Injection of oxidizing gas at the injector is then continued, to cause a pressure build-up in the reservoir to a level that is significantly greater than the original reservoir pressure but less than the fracturing pressure. In the Wolf Lake reservoir, the original reservoir pressure is about 2700 kPa and the fracturing pressure is about 10000 kPa. We typically pressure up the reservoir to about 5000–8000 kPa.

The pressure build-up causes the combustion front to penetrate from the channels into the adjoining cold portions or "banks" of the reservoir. The target pressure selected (termed the "blowdown pressure") preferably is high enough to also cause carbon dioxide, produced by combustion of the oil, to go into solution in the reservoir fluid.

At this stage of the process, some of the conditions that have been created are:

- that the network of channels has been heated by combustion and, depending on the amount of water injected and the original water saturation, the channel temperature is typically in the range 150°–1200° C.;
- portions of the reservoir cold banks adjacent to the channels have been heated sufficiently whereby some of the oil is now above its mobilization temperature, which for the Wolf Lake reservoir is about 75°–100° C.;
- the channels and adjoining cold banks have been pressured up to the blowdown value; and
- some $CO_2$ has gone into solution to reduce viscosity of the oil and to be available as a gas drive means when the reservoir is blowndown.

Preferably, some water is now injected into the channels, before commencing the blowdown phase. This is done with a view to cooling the channels below the temperature (350°–400° C.) at which coking of the oil is likely to occur. Also the water re-distributes the heat from the combustion zone down the channels and can cause heat breakthrough (150°–250° C.) at producers in the network, if such already had not been accomplished earlier in the process.

The blowdown is now initiated. More particularly, the producer wells are opened and oil, water and gas are produced with little or no restriction. Initially, large volumes of water and gas are produced, as these are largely the fluids that are in or are close to the channels. Then the rate of oil production increases and the rates of water and gas production decrease, as the mobilized oil flows from the pressurized reservoir matrix into each channel and through it to a producer. The blowdown is continued until the oil production rate falls off to a predetermined limit, such as the uneconomic limit.

During the blowdown phase, it is preferred to inject water at low rate into the injector. This is done with a view to preventing oil from entering the injector wellbore - if this were to occur, it could be a concern when re-igniting at that well.

During the blowdown phase, oil from the cold banks will have flowed into the channels. The presence of this new oil in the channels ensures that ignition and combustion can be obtained during the next pressure-up/blowdown cycle. 18. When the blowdown phase is terminated, then the entire process is repeated.

From the foregoing, it will be noted that the invention involves combining:

(1) forward combustion carried out at less than fracturing pressure through a network of pre-existing inter-well fluid communication channels "having a generally linear, narrow, permeable nature";

(2) advancing the combustion front at high speed through the network of interconnecting channels;

(3) using restriction of each producer - after gas breakthrough or preferably, heat breakthrough at that well, but before arrival of the combustion front - to protect the well by stalling the combustion front advance toward that well and causing it to travel down another channel toward another producer in the network;

(4) sequentially repeating step (3) for other producers connected by the channel network to induce the combustion front to move through a plurality and preferably all of the channels in the network;

(5) utilizing the combination of restriction of the producers, the impermeable nature of the oil-filled portion of the reservoir, and the continued injection of gas and water, to induce a reservoir pressure build-up in the channels to cause the combustion to occur at the edges of the channels and thereby encourage widening of the heated channels, and to pressurize the reservoir to a preselected blowdown value;

(6) preferably injecting water following pressure build-up but before blowdown, to cool the channels below the oil coking temperature;

(7) opening the producers to produce the heated oil in and near to the channels using built-up pressure, solution gas-drive, and the flashing of water to force the mobile oil toward the producers; and (8) repeating the foregoing cyclically;

to thereby provide a recovery strategy in which oil is produced at desirable rates through the life of the project.

As stated, the injection pressure is kept below the fracture pressure. This is done for two reasons:

- to ensure that the oxidizing agent stays in the reservoir to be produced and does not flow into other strata which are not to be produced (i.e. fracturing may penetrate above or below the oil reservoir); and
- to ensure that the oxidizing agent flows through the already established network interconnecting a group of wells, rather than creating new channels which may not link up with the producers.

In summary, the overall objective of the process is to heat up the oil and pressure up the reservoir adjacent to the network of channels as fast as possible to a predetermined level and then blow it down, using forward combustion as the means for heating and pressuring the system.

In a preferred feature of the process, a particular pretreatment, comprising cyclic steam stimulation ("huff and puff") at fracturing pressure, is practised on the reservoir to create the network of hot communication channels. As previously set forth, at the Wolf Lake project this pre-treatment, practised on the virgin reservoir, using wells aligned on-trend in parallel rows, was initially characterized by vertical fracturing. The vertical fractures extended on-trend between the wells. But over several cycles of huff and puff, off-trend fracturing began to develop. The result was the development of a network of communication channels, extending in both on-trend and off-trend directions, interconnecting a pattern of wells. This network was well adapted for use in connection with the subsequently applied cyclic pressure-up/blowdown combustion process.

Broadly stated, the invention is a process for producing oil from a heavy oil reservoir in which pressure can be built up by injection of oxidizing gas and propagation of a combustion front, said reservoir having completed therein an injection well and a plurality of production wells, said reservoir having a network of generally linear, narrow, permeable channels interconnecting the wells, the reservoir otherwise being resistive to fluid injection, said process comprising: (a) injecting oxidizing gas through the injection well and initiating combustion in the reservoir at the injection well; (b) injecting oxidizing gas through the injection well into the reservoir at a pressure less than the reservoir fracturing pressure and propagating forward combustion generally linearly toward a first of the production wells through a channel while producing said production well substantially unrestricted, to induce rapid advance of the combustion front through the channel, (c) when there is indication at the first production well that heat breakthrough has been established between the injector and said first production well, then restricting the first production well before the combustion front arrives at said first production well; (d) continuing to inject oxidizing gas through the injection well as before, with the first production well restricted, to induce rapid advance of the combustion front through another channel toward a second production well which is producing unrestricted; (e) when there is indication at the second production well that heat breakthrough has been established between the injector and said second production well, then restricting the second production well before the combustion front arrives at said second production well; (f) continuing to inject as before, with the production wells which have experienced heat breakthrough being restricted, to cause a significant pressure build-up in the network and surrounding reservoir to a pressure level which is less than the reservoir fracturing pressure; (g) substantially terminating oxidizing gas injection through the injection well; (h) injecting water through one of the wells to cool the burned channels; (i) opening at least one of the aforesaid production wells to produce oil and blowdown the reservoir, thereby re-saturating the burned channels with oil; and (j) igniting the oil in the re-saturated channel and repeating steps (b) to (i) inclusive at least once.

DESCRIPTION OF THE DRAWINGS

FIG. 9(*b*) is a plot of water injected over time for well T4 during combustion cycle 100;

FIG. 9(*c*) is a plot of gas produced over time for well T3 during combustion cycle 100;

FIG. 9(*d*) is a plot of gas produced over time for well T2 during combustion cycle 100;

FIG. 9(*e*) is a plot of downhole temperature taken over time at observation well Ob2 during combustion cycle 100;

FIG. 9(*f*) is a plot of surface injection pressure taken over time at well T4 during combustion cycle 100;

FIG. 9(*g*) is a plot of water production over time at well T2 during combustion cycle 100;

FIG. 9(*h*) is a plot of oil production over time at well T2 during combustion cycle 100;

FIG. 9(*i*) is a plot of oil production over time at well T3 during combustion cycle 100;

FIG. 9(*j*) is a plot of water production over time at well T3 during combustion cycle 100;

FIG. 9(*k*) is a plot of downhole pressure over time at well T3 during combustion cycle 100;

FIG. 9(*l*) is a plot of downhole pressure over time at well T2 during combustion cycle 100;

FIG. 10(*b*) is a plot of water injected over time at well T4 during combustion cycle 101;

FIG. 10(*c*) is a plot of oil produced over time at well T3 during combustion cycle 101;

FIG. 10(*d*) is a plot of oil produced over time at well T2 during combustion cycle 101;

FIG. 10(*e*) is a plot of downhole pressure over time at well T3 during combustion cycle 101;

FIG. 10(*f*) is a plot of downhole pressure over time at well T2 during combustion cycle 101;

FIG. 10(*g*) is a plot of water produced over time at well T3 during combustion cycle 101;

FIG. 10(*h*) is a plot of water produced over time at well T2 during combustion cycle 101;

FIG. 10(*i*) is a plot of gas produced over time at well T2 during combustion cycle 101;

FIG. 10(*j*) is a plot of downhole temperature over time at well Ob 02 during combustion cycle 101;

FIG. 10(*k*) is a plot of downhole temperature over time at well Ob 01 during combustion cycle 101;

FIG. 10(*l*) is a plot of surface injection pressure over time at well T4 during combustion cycle 101;

FIG. 10(*m*) is a plot of downhole pressure over time at well Ob 11 during combustion cycle 101;

FIGS. 12(*a*), (*b*) and (*c*) show the cumulative amounts of oxygen injected, oil produced and oil/oxygen ratio for the years 1983–85.

DESCRIPTION OF THE PREFERRED EMBODIMENT

The invention will now be described in greater detail in connection with the process employed at Applicant's Wolf Lake field pilot project. At this project, cyclic steam stimulation at fracturing pressure was used initially, creating interwell fluid communication channels in the otherwise substantially impermeable reservoir. A combustion flood was attempted after cyclic steam stimulation, with unsatisfactory results. And then the novel cyclic combustion pressure-up/blowdown procedure was gradually developed, with good results.

Figure 1:
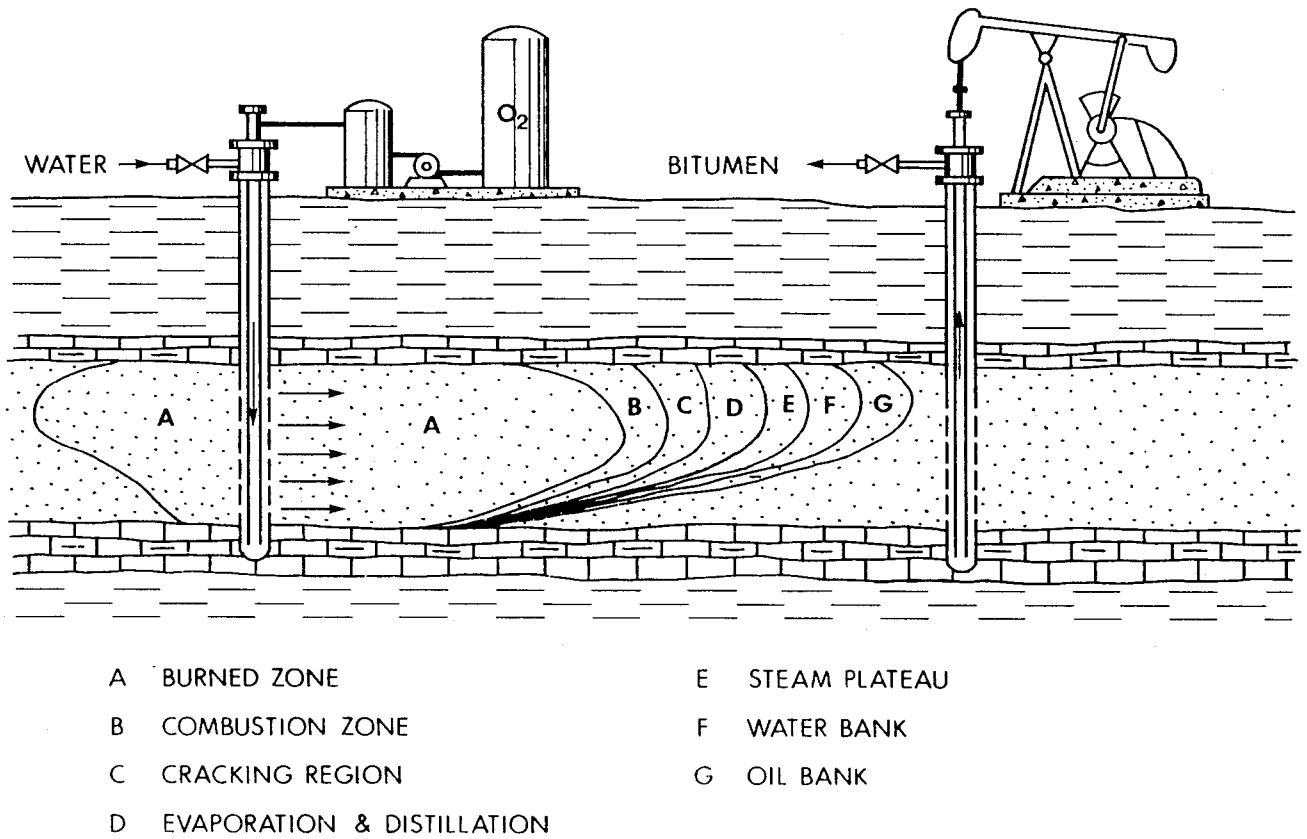
FIG. 1 is a schematic showing the zones which are typically involved in forward combustion.
Figure 2:
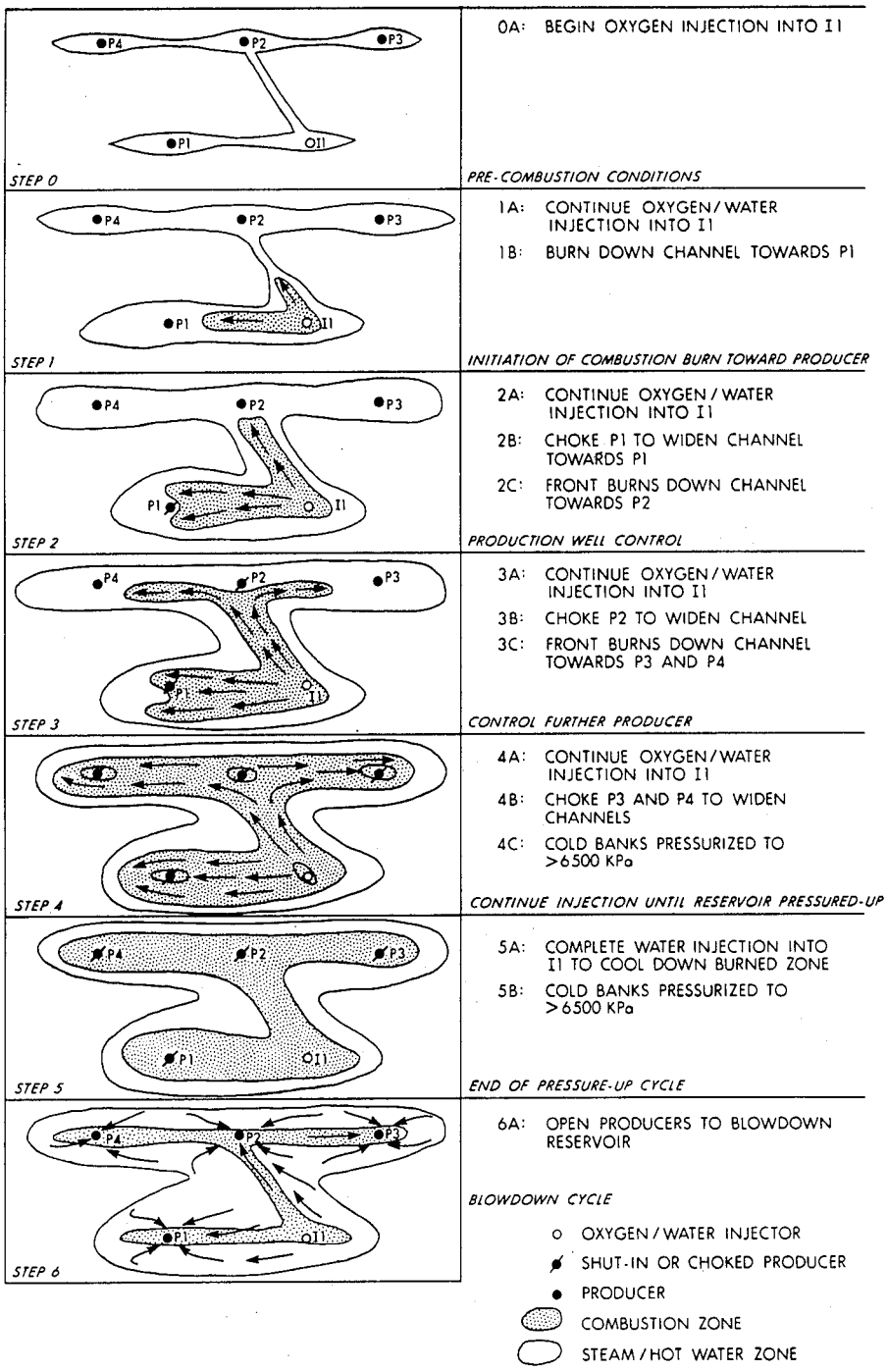
FIG. 2 is a schematic fanciful representation showing the steps of the process.
Figure 3:
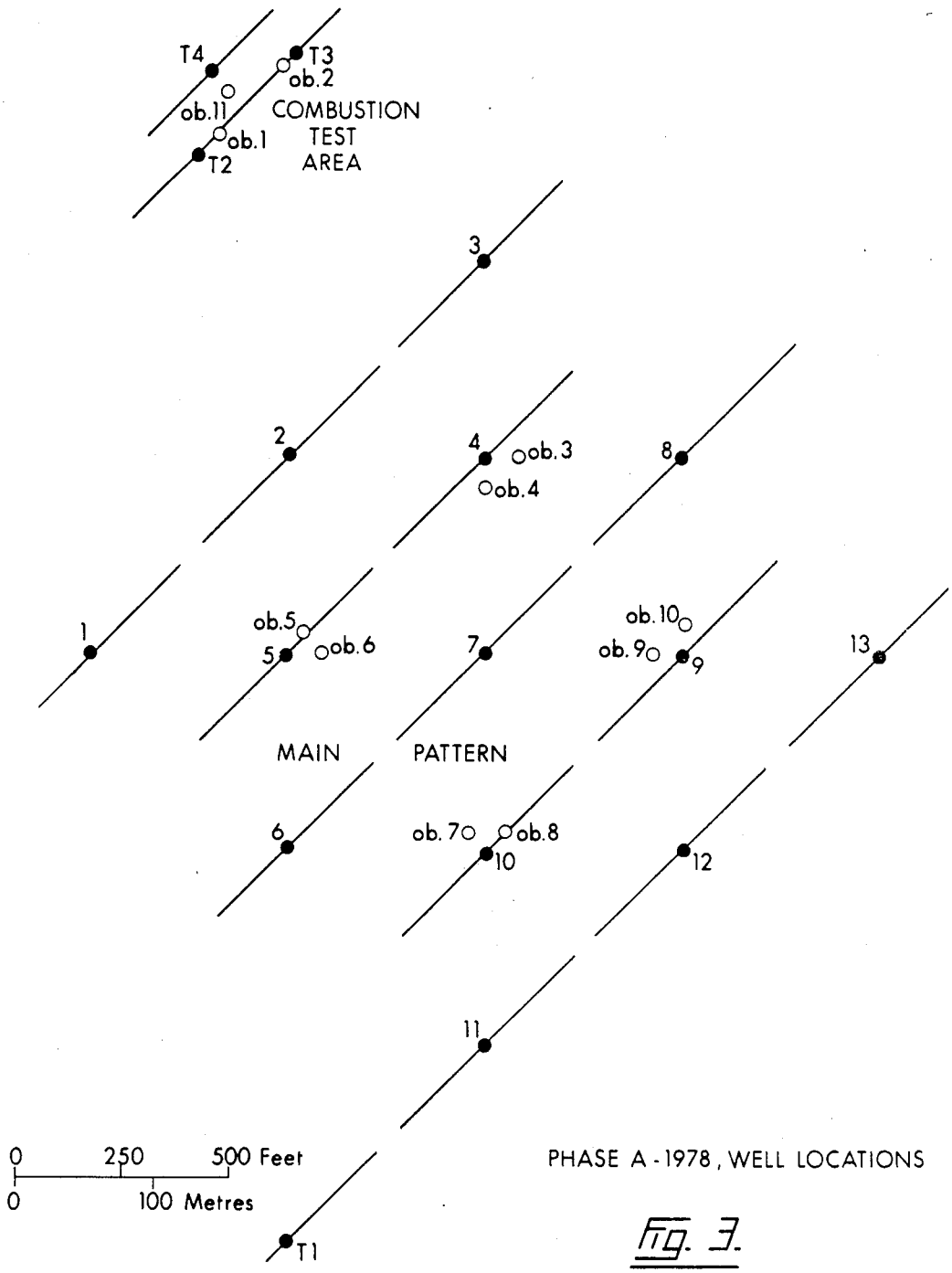
FIG. 3 is a plan of the well locations of applicant's pilot field project - the black dots indicate operating wells, the circles indicate observation wells, and the lines represent the on-trend vertical fractures or channels initially created in the process.

The pilot project involved operating two distinct and separate groups of wells. The groups are shown in FIG. 3.

Figure 7:
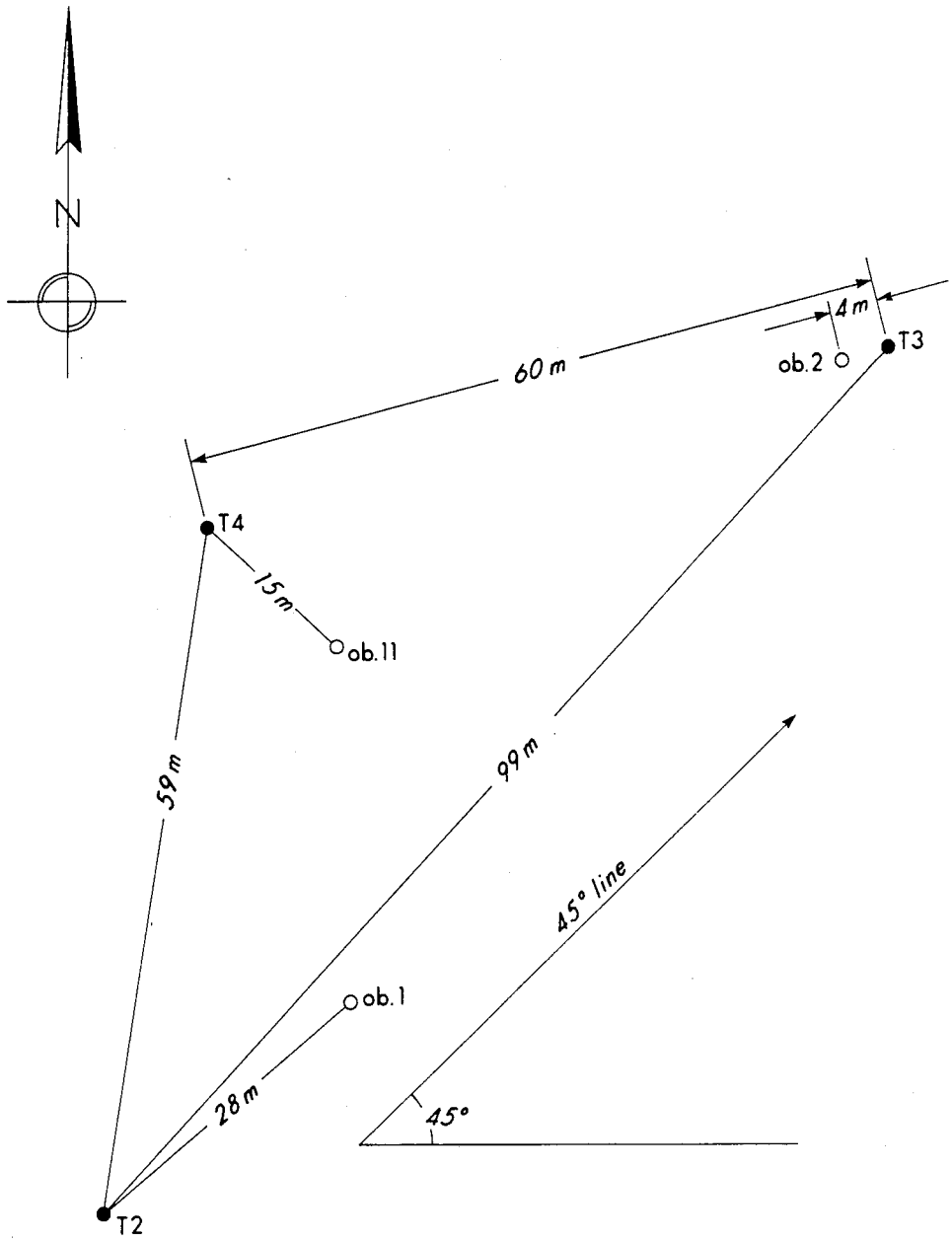
FIG. 7 is a plan of the well locations of the test area, with the spacing and alignment of the wells set forth.

One such group was referred to as the test pattern. By 1979 it consisted of three operating wells, with two of the wells (T2 and T3) aligned along the NE-SW trend and the third well (T4) positioned offtrend or to one side of the first pair. The spacing of the wells is set forth in FIG. 7. The well spacing was small (about 0.33 hectares per well), relative to what would be conventional, so that there would be early response at one well with respect to an action taken at another well. Three observation wells (OB 1, OB 2 and OB 11) were provided in the test pattern, for monitoring reservoir conditions.

The second group of wells was referred to as the "main pattern". The main pattern wells were arranged in five on-trend rows and included two observation wells adjacent to each of the intended injectors. The wells of the pattern were originally arranged with a relatively large spacing, of about 2.5 hectares/well. The main pattern was subsequently infill drilled in 1981 by adding wells 21–25 to provide ~1.0 hectare/well spacing in some areas of the pilot.

The combustion test area was designed to operate on cyclic steam stimulation for about one year, with a view to then converting the test pattern to a forward combustion flood to provide combustion experience for use in the main pattern. Concurrently cyclic steam stimulation was to be practised in the main pattern for a three year period.

THE COMBUSTION TEST AREA

As previously stated, the test was originally conceived as a combustion flood from T3 to T2 following a one-year cyclic steam stimulation pre-heat phase. It was intended that T2, the producer, would remain on cyclic steam injection until response from the flood was evident.

T2 was the first well to receive steam. During June and July, 1978, 1 164 $m^3$ of steam were injected at a rate of 104 $m^3$/d. To inject at this rate the formation had to be fractured. A rapid pressure increase from 2,400 to 3,700 kPa at well T3 showed that the fracture was aligned in a northeast-southwest direction. The alignment of the fracture was also confirmed by a temperature rise to over 300° C. at OB 1.

Based on these observations, it was predicted that the combustion front would travel too quickly to T2 if air injection were to be initiated at T3, as originally proposed. It was therefore concluded that a cross trend flood would have a greater chance of success.

The new strategy required drilling two new wells, an injector T4 and an observation well OB 11 (see FIG. 3). T4 was drilled in December, 1978, and OB 11 in February, 1979.

Figure 8:
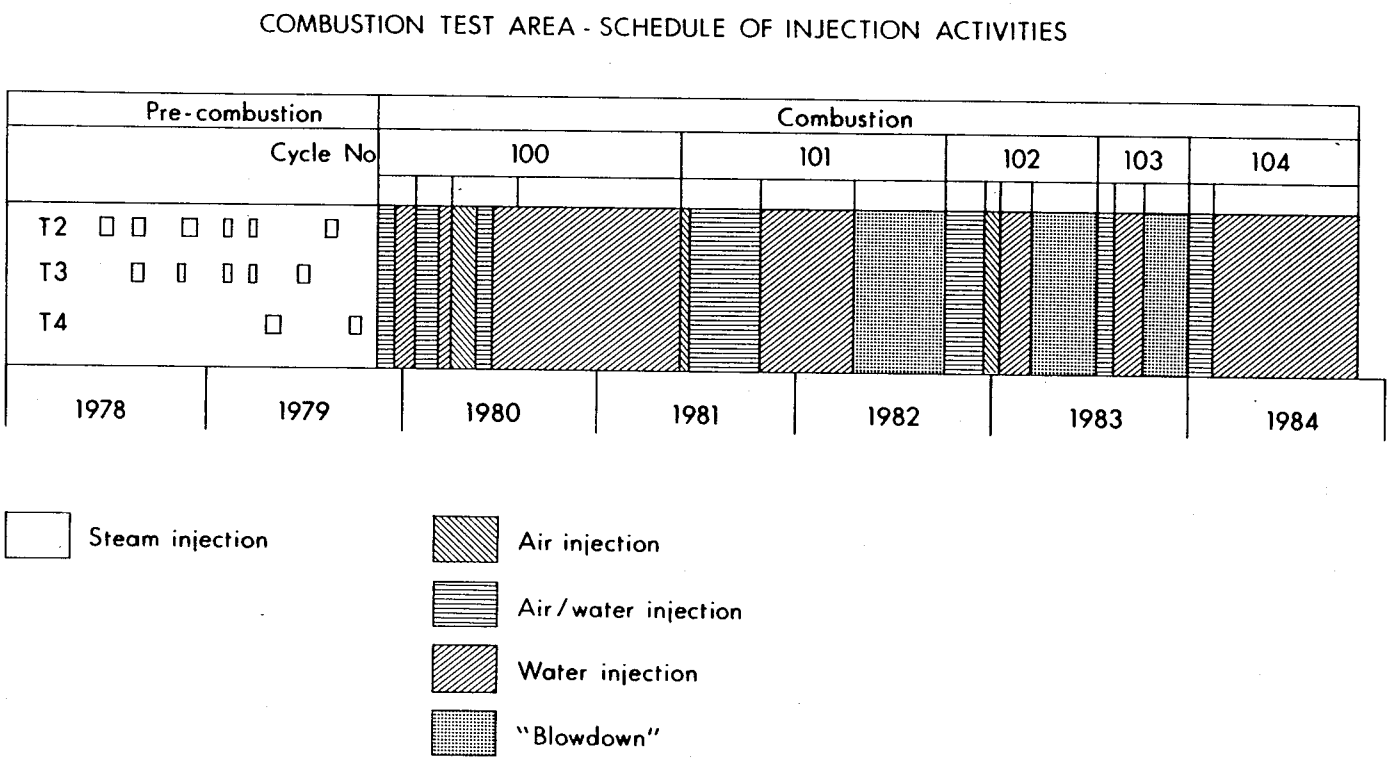
FIG. 8 is a schematic representation showing the nature and duration of the injections practised at the test area of the pilot field project.

Commencing in August, 1978, wells T2 and T3 were cyclically steamed, essentially together, through 4 huff and puff cycles. FIG. 8 shows the schedule of these cycles and Table I sets forth the volume, time and injection rate details.

TABLE I

| | | COMBUSTION TEST AREA STEAMING HISTORY | | | |
|---|---|---|---|---|---|
| WELL | NUMBER | INJECTED $m^3$ | CUMULATIVE STEAM INJECTED $m^3$ | INJECTION DAYS | AVERAGE INJECTION RATE $m^3$/d |
| T2 | 1 | 1 164 | 1 164 | 11.2 | 104 |
| | 2 | 851 | 2 015 | 13.6 | 63 |
| | 3 | 1 441 | 3 456 | 9.9 | 146 |
| | 4 | 1 059 | 4 515 | 5.3 | 200 |
| | 5 | 1 123 | 5 638 | 8.7 | 129 |
| | 6 | 6 971 | 12 609 | 24.8 | 281 |
| T3 | 1 | 1 518 | 1 518 | 13.5 | 112 |
| | 2 | 1 194 | 2 713 | 6.6 | 181 |
| | 3 | 1 065 | 3 778 | 5.3 | 201 |
| | 4 | 1 137 | 4 915 | 8.7 | 121 |
| | 5 | 2 359 | 7 274 | 19.8 | 119 |
| T4 | 1 | 5 080 | 5 080 | 25.5 | 199 |

As shown, T3 received its first slug of 1518 $m^3$ of steam in August/September, 1978, at an average rate of 112 $m^3$/d. During injection of the first steam slug at T3, observation well OB 2 reached a downhole temperature of 90° C. - this indicated that the observation well was slightly off the fracture trend. During the course of later steam cycles at T3, the temperature observed in well OB 2 eventually reached 300° C., indicating that the heated channel was widening.

Cyclic steaming was initiated at T4 in April/May, 1979. The well received a single slug of steam in the amount of 5080 $m^3$ at an average rate of 199 $m^3$/d. T4 was then placed on production.

It was not possible to determine whether the steaming of T4 was affecting T2 and T3 (which were undergoing their 5th and 4th cycles respectively). However, what is clear is that T4 did not directly link up to T2 or T3. The temperature at OB 11 rose only a few degrees during T4's steaming cycle, indicating that the fracture connecting with T4 probably extended NE-SW. Off-trend heating appeared to be by way of conduction only.

During June/July, 1979, T3 received a further steam slug, while T2 remained on production. This slug was intended as a steamflood from T3 to T2 to prepare a heated linking passage between the wells in readiness for the planned cross trend combustion flood from T4. The slug (2,359 $m^3$) was approximately twice the size of the previous slugs (see Table I). However, T4 responded to the injection at T3, whereas T2 did not. This response was strong in that fluid flowed to surface at T4 approximately two weeks after cycle 5 steam injection started at T3, clearly showing a strong direct link between the wells. This was the first indication of cross trend links due to changes in the reservoir tectonic stresses, with the fracture now being in a east-west direction rather than northeast-southwest.

Subsequently T2 received a large cycle (6,971 $m^3$) of steam to pre-condition the T2–T3 channel for the cross-trend flood from T4.

In total, T3 received five steam stimulation cycles, T2 received six cycles, and T4 received one cycle in readiness for the combustion phase.

Communication channels were established between T2 and T3 during the first steaming cycle and a channel between T3 and T4 during cycle 5. The results are indicated schematically in FIG. 4.

Figure 4:
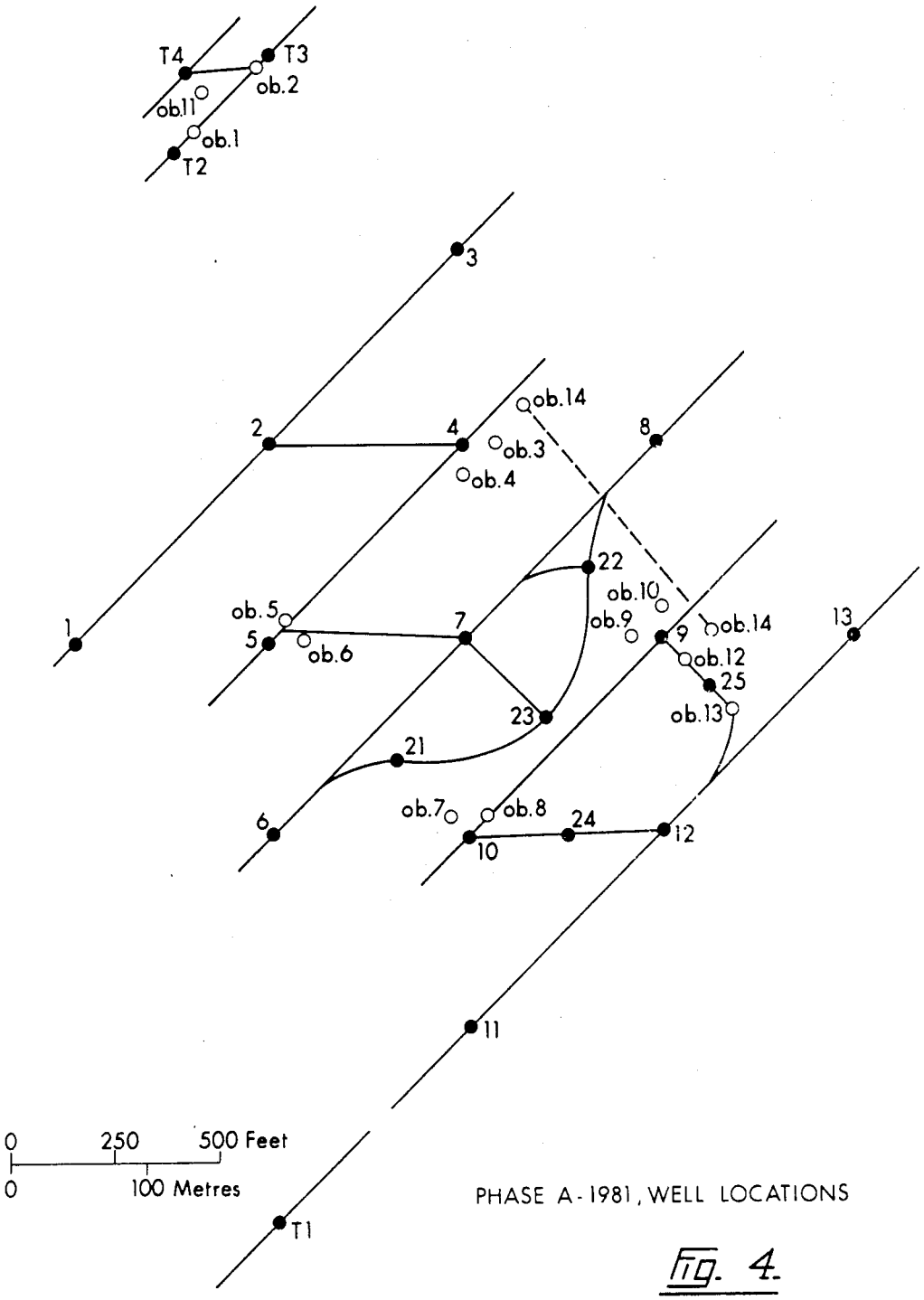
FIG. 4 is a plan of the pilot field project wells after cyclic steam stimulation - the lines represent the network of on-trend and off-trend channels which had been developed.
Figure 5:
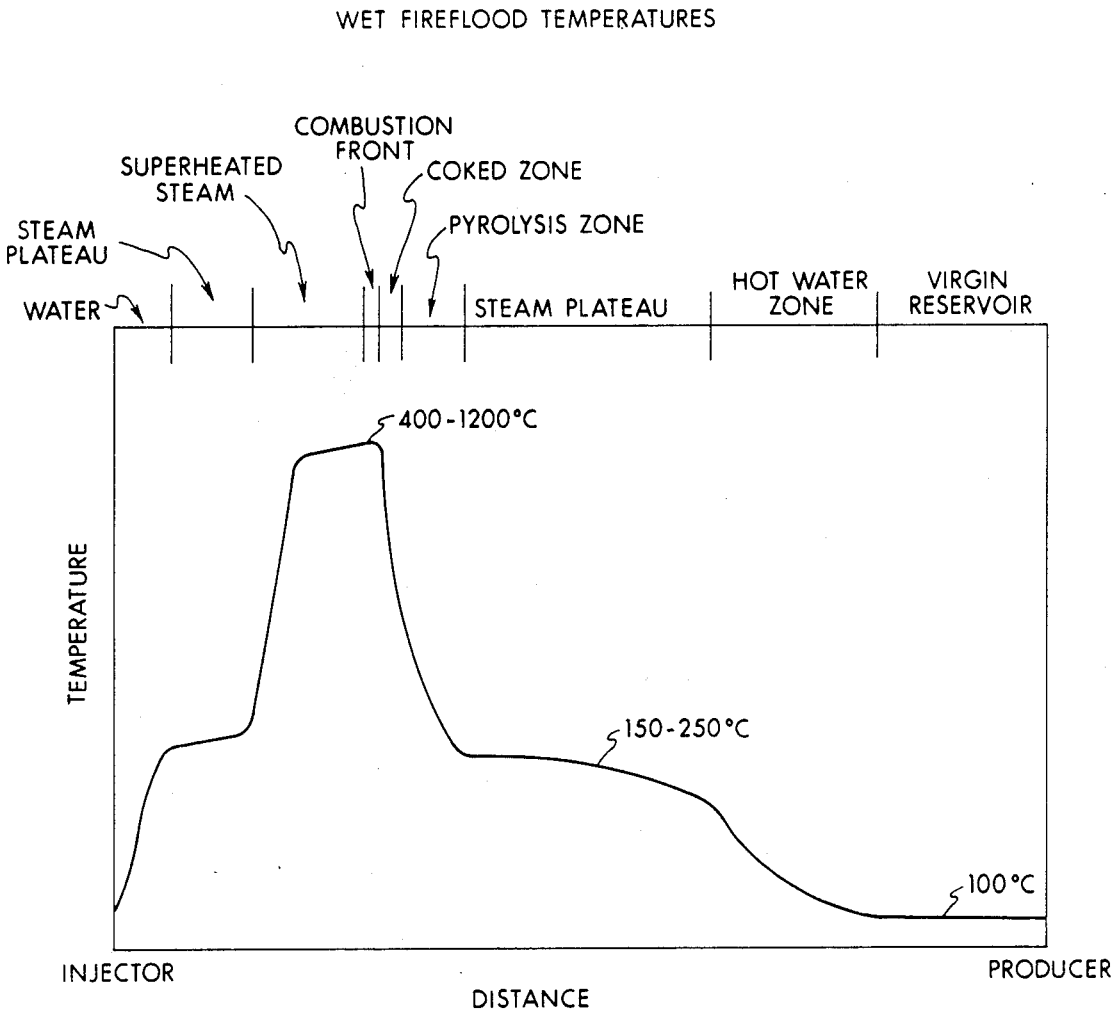
FIG. 5 is a typical temperature profile between an injector and a producer, said profile corresponding with the zones of FIG. 2.
Figure 6:
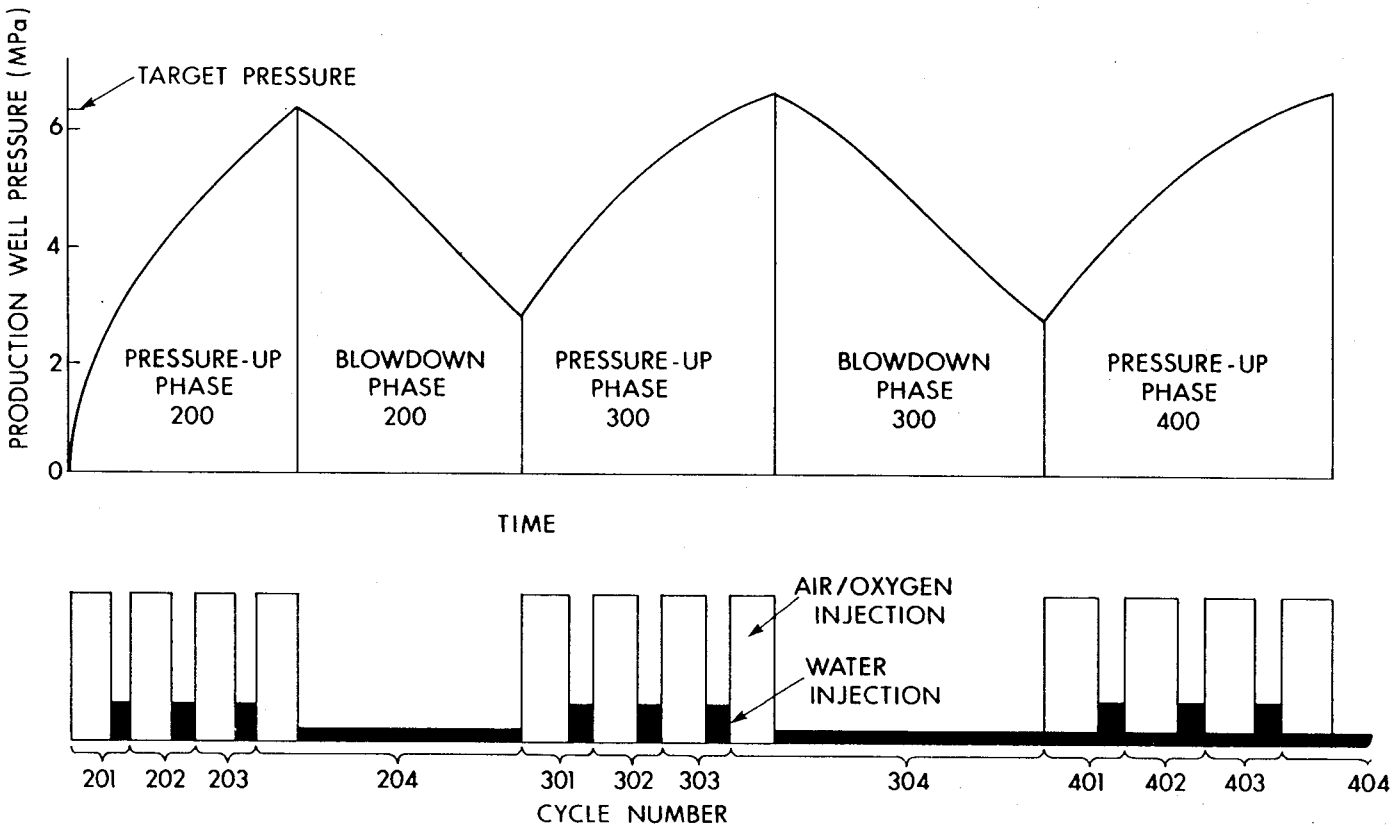
FIG. 6 is a schematic representation of the predicted pressure variation on what might occur at a producer undergoing cyclic pressure-up and blowdown phases in accordance with the process and a possible injection sequence at the injector.

The linking channel between T3 and T4 was not expected, because until that time no other cross links had been formed in the pilot project. At a later date, cross links were observed in the main pattern (as indicated in FIG. 4). These cross links were believed to be caused by in-situ stress changes caused by the cyclic steaming.

The combustion phase essentially began in September , 1979, with the injection of a 1,798 $m^3$ slug of steam into T4 to warm up the near wellbore area to encourage spontaneous ignition on air injection. Air injection was initiated at T4 in November, 1979.

Even at this time it was still considered that a cross trend combustion flood was possible from T4 over to the T2–T3 line, because it was not known how dominant the communication channel between T4 and T3 was and would become. The original strategy for the test was to inject alternating slugs of air and water at T4 until the combustion front arrived at the T2 and T3 wells after burning across the cold bank, between T4 and the T2–T3 line, and down the channels.

At ths time it was planned that, common to other projects, when the heat front arrived at the production wells the process would be terminated. It was also intended that increasing volume air slugs would be used as well as different air and water injection rates, to determine the optimum injection parameters. Also, during air injection, water would be injected at low rates to prevent a burn back to T4.

In fact, only three air and water slugs were injected through T4 before the flooding process was abandoned. The details of these slugs are set forth in FIGS. 9*a* and 9*b* and are described below. They are collectively referred to as combustion cycle 100.

The first air slug lasted from Nov. 14 to Dec. 18, 1979, and during that time 929,332 $Sm^3$ of air were injected at an average rate of 27,000 $Sm^3$/d;water was injected simultaneously at 17.3 $m^3$/d. Then between the first and second air slugs, water was injected at 18.6 $m^3$/d (see FIGS. 9*a* and 9*b*).

The second air slug lasted from Jan. 29 to Mar. 10, 1980, and during that time 1,232,062 $Sm^3$ were injected, at first at a rate of 38,000 $Sm^3$/d. The rate was decreased to about 12,000 $Sm^3$/d during the last 12 days of the injection period. The average rate of air injection was 29,000 $Sm^3$/d. The water rate during this time was 4.0 $m^3$/d. The water injection rate between the second and third air slugs was increased to an average of 105 $m^3$/d.

The third air slug lasted from Apr. 1 to July 7, 1980, and during that time 1,632,896 $Sm^3$ were injected, at first at a rate of 13,000 $Sm^3$/d. This rate was increased abruptly on June 25, 1980, (until July 7, 1980) to 41,000 $Sm^3$/d in order to perform a pressure build-up test. The average air injection rate for the third slug was 17,000 $Sm^3$/d. Water was injected during this time at 1.6 $m^3$/d.

From July 7 to Aug. 1, 1980, the water injection rate was increased to an average of 168 $m^3$/d. Injection of cooling water continued until the end of May, 1981, at an average rate of 8.4 $m^3$/d.

The total air injected during cycle 100 was 3,794,290 $Sm^3$. The total water injected was 10,165 $m^3$. The water-air ratio (WAR) at the end of air injection (July 7, 1980) was 0.89/1,000 $m^3$. After the end of heat scavenging water injection (August, 1980) the WAR was 2.02 $m^3$/1,000 $m^3$ and at the end of the entire cycle, the WAR was 2.68 $m^3$/1,000 $m^3$.

The reasoning for abandoning the flooding process and developing a new process will now be described.

Following commencement of air injection at well T4 on Nov. 14, 1979, within a period of one day an increase in gas production was noted at well T3 and, shortly thereafter, at well T2. This is shown in FIGS. 9*c* and 9*d*. This indicated that there was a high mobility channel between wells T4 and T3 and T3 and T2.

By Dec. 5, 1979, the temperature at observation well OB 2, immediately adjacent well T3, had risen to 340° C. from a temperature level that had previously hovered about 185°–200° C. This is shown in FIG. 9*e*. The abrupt temperature increase signalled the imminent arrival of the combustion front at wells OB 2 and T3, after only three weeks of injection at well T4. Thus the rate of advance of the combustion front from T4 to T3 could be said to be rapid, being in the order of 2–3 meters/day. This was indicative of flow down a channel rather than a flood process which, as mentioned earlier, typically should have frontal velocities of 0.03–0.06 meters/day.

To protect wells OB 2 and T3, water injection was then immediately commenced through well T3. Air injection at well T4 was continued and well T2 was left open.

Following the rapid breakthrough of gas at T2 the gas continued to increase to the end of the injection of the first air slug and declined rapidly thereafter. Oil and water production rates also increased during air injection. However, when water was produced at very high rates (mid-December, 1979), the oil production rate dropped to zero. When air injection stopped, the water production rate declined and the oil production rate increased again (see FIGS. 9*g* and 9*h*) .

Figures 9G, 9H, 9I, 9J, 9K, 9L:
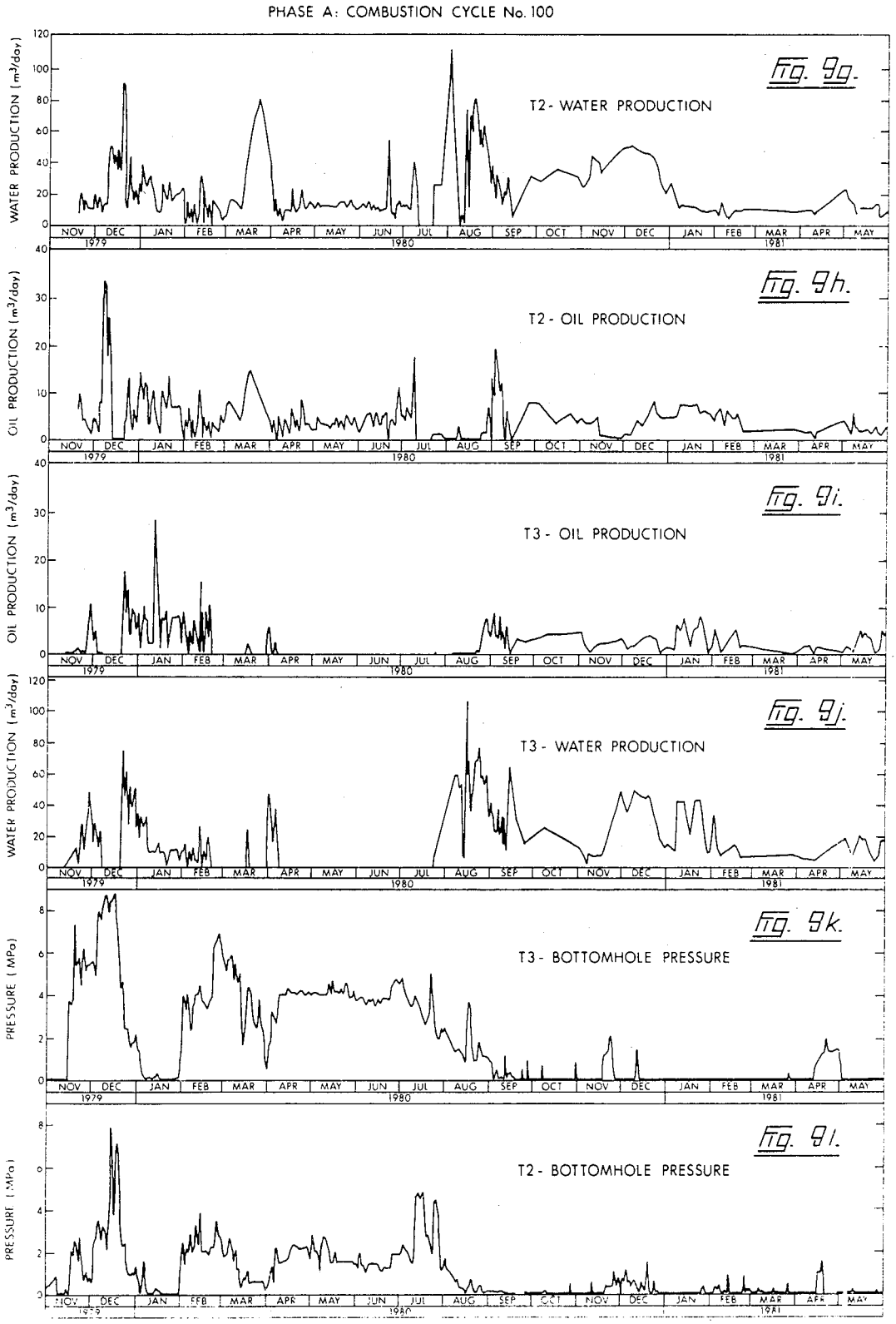
FIG. 9(*a*) is a plot of air injected over time for well T4 during combustion cycle 100.

Prior to placing T3 on water injection on December 7 the water production increased along with the gas rate, while the oil production showed a temporary rise for a few days (see FIGS. 9*i* and 9*j*).

On Dec. 18, 1979, air injection was stopped at T4 and water injection was increased.

A few days later, on December 21, the protective water injection at well T3 was terminated and the well was placed back on production along with well T2.

When the second air slug was injected into T4, there was an immediate and sustained increase in gas production at T3. The rates observed were higher than those which occurred during the injection of the first air slug. Oil and gas rates, which had been declining, did not increase when the second air slug was injected (see FIGS. 9*i* and 9*j*).

In response to this second slug the temperature in observation well OB 2 rose quickly and reached a temperature of 603° C. on Feb. 22, 1980, from a re-injection temperature of 200° C. Again, it signalled the arrival of the leading edge of the combustion front.

On Feb. 23, 1980, water injection was started into T3 to protect it and OB 2. This protective water injection continued until March 12. When T3 was returned to production, high rate water injection at T4 was in progress. T3 produced at a high oil rate for four days; the rate then substantially declined. The water production rate increased, then decreased when the water injection at T4 stopped.

On injection of the second air slug at T4, the gas production rate at T2 again rose sharply, but did not reach the same level as during the first slug. The oil and water rates fluctuated, showing no positive trend. However, when the water injection rate at T4 was increased to 105 $m^3$/d (March 11–31, 1980) following the second air slug, there was a dramatic increase in the oil and water production rates at T2. The water production rate of T2 fell off immediately after the water injection rate at T4 was reduced to O $m^3$/d prior to injection of the third air slug.

During the third air slug at T4, T3 was shut in from Apr. 8 to July 23, 1980, and again from July 29 to Aug. 4 because of high temperatures at OB 2. Therefore it was shut in during most of the third air slug and for most of the period of high rate water injection which followed.

During the third air slug, T2 was produced without choking and produced high levels of gas (see FIG. 9*d*). The oil production rate also rose during this phase, whereas the water production did not change (see FIGS. 9*g* and 9*h*).

The temperature at OB 2 increased from 304° C. (Mar. 30, 1980) to a maximum of 666° C. on June 30, 1980. T3 was shut in on Apr. 8, 1980, to control high temperatures at the well.

Therefore at the end of the third high rate water injection, which lasted until Aug. 1, only 50% of the oil eventually produced due to the last pre-combustion steam cycles and combustion had been produced. Also, T3 was shut in through most of the air injection phase and the high gas rates at T2 were suppressing the fluid production. These factors would result in thermal efficiencies and production rates for a flood process that would be uneconomic. Thus, following 8½ months of air and water injection there was approximately 50% of the oil still to be produced. The wells were flowed and then pumped for a further 10 months to produce the mobilized oil.

In total, 3,795,288 $m^3$ of air were injected in three slugs of 930,331 $m^3$, 1,232,061 $m^3$ and 1,632,896 $m^3$. In response to this injection, 1,908 $m^3$ of combustion oil were produced, for an air-oil ratio of 1,989 $m^3$. Also 2,105 $m^3$ of oil were produced due to precombustion steaming. The volume produced due to the steam was calculated from the prior steaming history and the combustion oil by difference from the cumulative oil produced.

From the results, it was clear that a combustion flood would not be possible because of the early arrival of the combustion front at the production wells due to the channelling problem, which forced T3 to be shut in with protective water injection for most of the injection period. Also the process would only deplete the heated channel system, which was small in volume compared to the available cold bank volume. However, a review of the data obtained during the 3 slug phase indicated that the reservoir was being pressured up. FIGS. 9*k* and 9*l* show the downhole pressure at wells T2 and T3 during this phase. On numerous occasions, the pressures reached higher values than the original reservoir pressure.

At this point a new design of combustion cycle was conceived and initiated. This cycle was designated '101'. It was to comprise:

(a) injecting air and water into well T4 while producing wells T3 and T2;

(b) after a period of operating in accordance with (a), then restricting T3 and T2 and continuing to inject air and water through T4 at a sufficient rate so as to cause a pressure build up at T3 and T2, to about 5,000 kPa;

(c) then producing T2 and T3 until the production rate stabilized, while air injection was continued at T4; and (d) then again restricting T2 and T3 and continuing to inject air at T4, to pressure the reservoir up to 8,000 kPa Cycle 101 was initiated on July 13, 1981. A slug of air was injected into the reservoir through well T4 over the period mid-July to late-October, 1981. This slug of air was followed by a slug of water injected over the period late-October to late November, 1981. The volumes injected were 2,648,927 $Sm^3$ of air and 4,902 $m^3$ of water. The injection rates are set forth in FIGS. 10(*a*) and 10(*b*).

The air was injected into T4 at a relatively low rate initially (6,000–8,000 $m^3$/d), to conduct a pressure build-up test. By July 28, 1981, the wellhead pressure had stabilized at about 2,200–2,400 kPa, and the air injection rate was increased to 42,000 $m^3$/d.

During cycle 100, evidence of severe channelling between T4 and T3 had been seen. In cycle 101 the gas production at T3 increased within a day of starting injection at T4. Following the establishment of a high gas permeability in the T3/T4 channel, the wellhead annulus gas vent at T3 was almost completely shut in on July 26. Only a small portion of the total gas production was therefore produced at this well. In this way, the pressure in the T4-T3 channel increased and it encouraged the combustion front to burn a wider zone in the channel and to stay away from T3.

Temperature response occurred first at OB 02 and then at T3, after almost 700,000 $m^3$ of air had been injected into T4. This was twice the volume of air that had been injected during cycle 100 when temperature increases were first noted for these wells.

By Aug. 18, 1981, the cumulative air slug injected into T4 was about 980,000 $m^3$. In order to increase the casing head pressure to 5,000 kPa, wells T2 and T3 were shut in on Aug. 20 while air injection was continued at T4.

The casing head pressure at T3 increased rapidly to 5,400 kPa. Within five hours following shut in of T3, the well was placed back on production. It was produced for six days, after which it was again shut in, to promote pressuring up of T2 (see FIGS. 10*c, d, e*). Other reasons for this action were that little fluid was being produced at T3 and that the temperature was continuing to increase at T3 and OB 02. (The temperature at OB 02 reached 590° C.).

In contrast to T3, the casing head pressure at T2 increased only slowly to 5,000 kPa. On Aug. 31, 1981, it was put back on production with a back pressure of 5,000 kPa being maintained. On Sept. 24, 1981, the well was shut in due to treating problems.

Figures 10A, 10B, 10C, 10D, 10E, 10F:
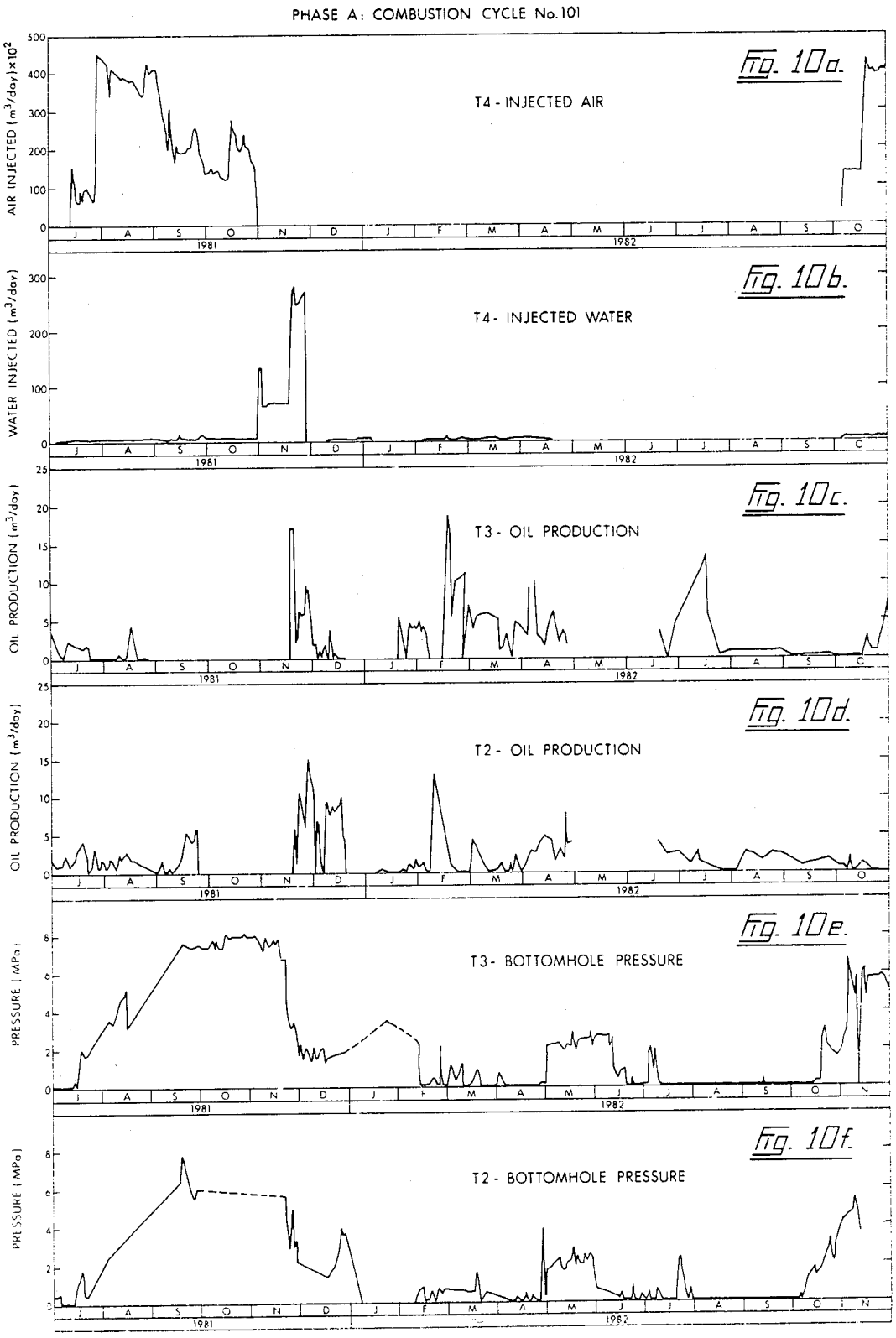
FIG. 10(*a*) is a plot of air injected over time at well T4 during combustion cycle 101.

During the time that T2 was produced with a back pressure of 5,000 kPa, oil, water and gas production rates increased dramatically. This is shown in FIGS. 10*f, g, h* and *i*.

Figures 10G, 10H, 10I, 10J, 10K, 10L, 10M:
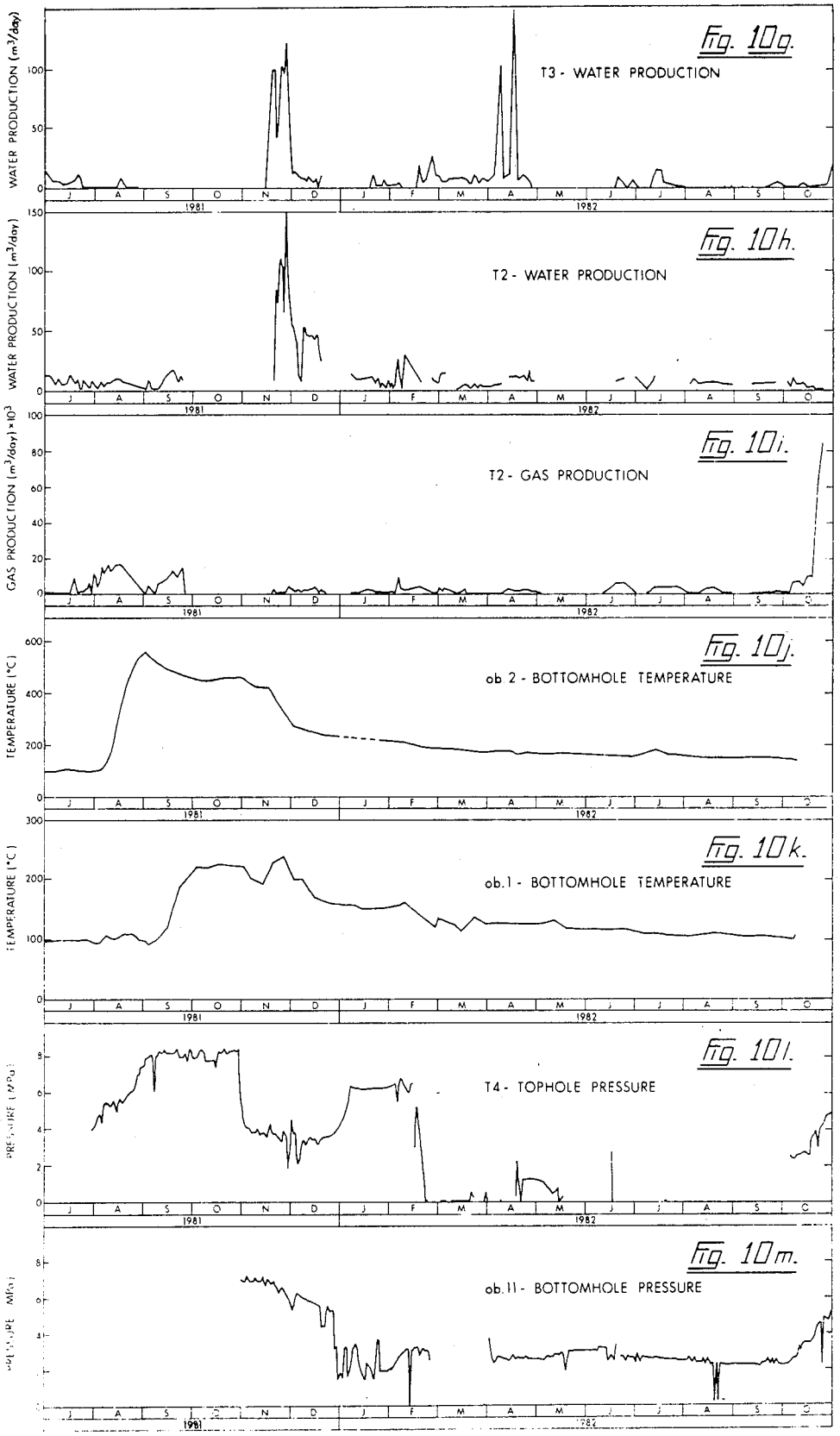

During the injection phase, the temperature at well OB 2 had been seen to commence increasing in early August; it rose from about 106° C. and reached about 559° C. by early September, when well T3 was shut in (see FIG. 10*j*). Commencing in mid-September, the temperature at well OB 1 (near to well T2) began to rise from about 95° C. and reached about 237° C. in early October, which meant the steam/water front had arrived (see FIG. 10*k*). At well OB 11, the temperature recorded (67° C.) was not higher than the maximum temperature observed at this well during cycle 100.

Air injection into T4 continued with T2 and T3 shut in until Oct. 29, 1981. Air injection was terminated when the reservoir pressure approached 8,000 kPa - which was confirmed by the bottomhole pressures at OB 11 and T4 (see FIGS. 10*l* and 10*m*). FIGS. 10*f* and 10*e* show the pressures at T2 and T3 and further demonstrate that the pressure in the channels had reached the target value of 8,000 kPa.

With the termination of air injection at T4 on Oct. 29, 1981, combustion water injection was initiated into T4. A WAR of 1.4 $m^3$ /1,000 $Sm^3$ was obtained. The water was initially injected at a low rate of 60–70 $m^3$/d. On Nov. 17, 1981, the rate was increased to about 260 $m^3$/d. On Nov. 26, 1981, combustion water injection was discontinued and cooling water injection (6 $m^3$/d) began.

Wells T2 and T3 were placed on production during the high rate water injection period. The fluid production response is shown in FIGS. 10*c*, 10*d*, 10*g*, and 10*h*. It will be noted that both water and oil production rates increased during high-rate water injection into T4.

Over the course of cycle 101, 2,648,927 $Sm^3$ of air and 4,902 $m^3$ of water were injected and the reservoir was pressured up to about 8,000 kPa. During the production phase, 1,865 $m^3$ of oil were produced for an air/oil ratio of 1,420 $Sm^3/m^3$, which is equivalent to a steam/oil ratio of 2.3. These figures indicate the process of cycle 101 was more than twice as efficient as had been achieved during cyclic steaming.

The following observations were made from the results of practising cycles 100 and 101 in the test area:

(1) that the cyclic wet combustion pressure-up/blowdown procedure, when practised in the network formed in the Wolf Lake reservoir, was 2–3 times as efficient as cyclic steaming;

(2) that a conventional in-situ combustion frontal drive or flood could not be applied to a substantially impermeable oil sands reservoir dominated by heated fluid communication channels left as a remnant of a preceding cyclic steaming treatment; and (3) that the new process, comprising the combination of rapid combustion front advance through the network of channels using less than fracturing injection pressure, sequential restriction of the producers upon imminent heat breakthrough, pressuring up the reservoir to a high pressure close to but less than the fracturing pressure, and then blowing down the reservoir, was successful in producing the channel-containing oil sands reservoir.

Subsequent to cycles 100 and 101 four further pressure-up blowdown cycles were conducted in the test area with satisfactory results. The timing of these cycles is shown in FIG. 8.

However, despite the achievement of improved performance of combustion over steam, as measured by the low air-oil and equivalent steam-oil ratios, the oil production rates were low.

One aspect of the process to be considered was the role of nitrogen, which forms 4/5 of the injected air. Since it is noncondensable, it is unlikely to have been very useful in improving recovery. In fact, it causes a number of problems, more particularly:

(1) it reduces the partial pressure of carbon dioxide in the reservoir, so less carbon dioxide goes into solution and thus the oil viscosity is higher; and (2) it travels quickly to the production wells and the resulting increased gas production rate reduces the oil and water production rates.

It was hoped that these problems could be ameliorated by the use of oxygen rather than air as the oxidizing gas. This was evaluated in the main pattern of the project.

Further, it was felt that having both producers on the same side of the injector was not optimal. An improved situation would be to have a producer on each side of the injector, so that the front could be manipulated more efficiently.

Use of Oxygen

Figure 11:
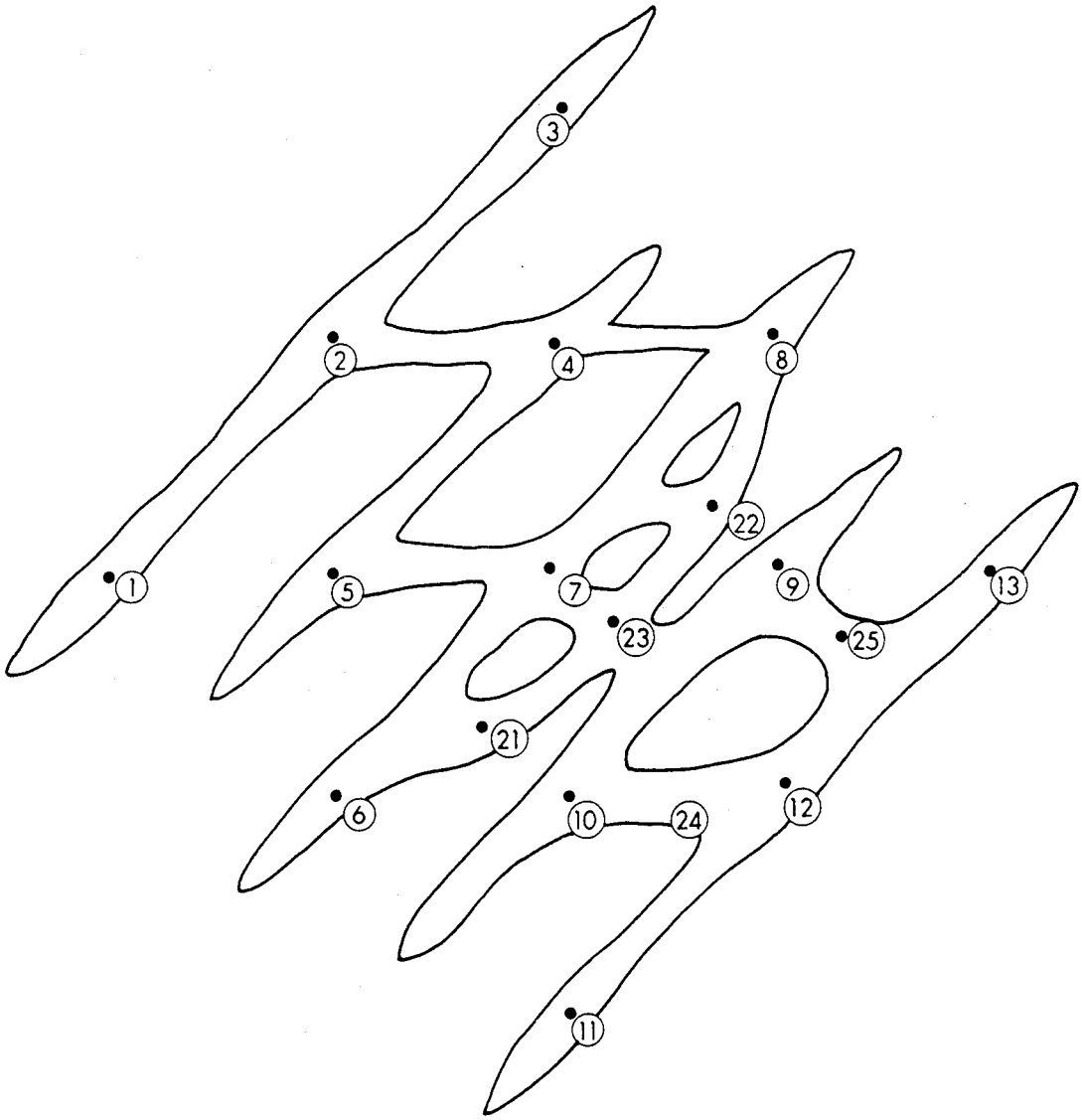
FIG. 11 is a plan of the main pattern showing a fanciful representation of the network of channels developed by mid-1984.

Up to March, 1983, the main pattern had been subjected to over 5 years of cyclic steam stimulation. The network of hot channels that had been developed in the pattern by steaming/producing is fancifully represented schematically in FIG. 11. The channels typically had temperatures in excess of 100° C., while the cold banks were about 15° C.

On Mar. 17, 1983, forward combustion, using oxygen as the injected gas, was initiated with well 4 at the injector. Oxygen injection lasted until June 27. This was followed by water injection until Oct. 14. During this period, gas breakthrough was established at well 5 in a few days. Heat breakthrough occurred at well 5 in mid-May. Gas breakthrough was also strongly established at wells 1, 2, 3, 21, 22 and 23 and weakly established at wells 6, 7 and 8. Throughout this 6 month period, the injection well completion was being tested and the pressureup/blowdown procedure was not operated.

In response to the injection of 679,590 $m^3$ of oxygen, 1,555 $m^3$ of oil were produced for an oil/oxygen ratio of 1.69 $m^3$/tonne (437 $Sm^3$ of $O_2$ per $m^3$ of oil).

Following this initial injection, wells 7 and 25 were converted to injectors.

Pressuring up of the main pattern was initiated in October, 1983. However, by May, 1984, problems with the injectors caused injection to be terminated. By that time, a further 2,183,673 $m^3$ of oxygen had been injected and the reservoir had been partially pressured up. In response to this injection, by July, 1984, 5,694 $m^3$ of oil had been produced for an oil/oxygen ratio of 1.96 $m^3$/tonne.

In mid-1984, well 9 was converted to an injector to replace well 25, which was damaged beyond repair.

Re-pressurization of the reservoir was started again in July, 1984, by injecting oxygen through the injectors. Another 5,301,829 $m^3$ of oxygen were injected and over 70% of the portion of the reservoir underlying the main pattern was pressured to over 5,000 kPa.

The reservoir was then blown down by opening the producers. In total, 25,700 $m^3$ of combustion oil were produced at higher rates than those seen in the test pattern. The oil/oxygen ratio was 2.3 $m^3$/tonne.

From this testing, it was determined that the reservoir could be pressurized with oxygen and the oil production rate was higher due to the absence of nitrogen. The equivalent air-oil ratio was 1,530 $m^3/m^3$, which is comparable to the values obtained in cycles 100 and 101 with air.

The embodiments of the invention in which an exclusive property or privilege is claimed are defined as follows:

1. A process for producing oil from a heavy oil reservoir in which pressure can be built up by injection of oxidizing gas and propagation of a combustion front, said reservoir having completed therein an injection well and a plurality of production wells, said reservoir having a network of generally linear, narrow, permeable channels interconnecting the wells, the reservoir otherwise being resistive to fluid injection, said process comprising:

(a) injecting oxidizing gas through the injection well and initiating combustion in the reservoir at the injection well;

(b) injecting oxidizing gas through the injection well into the reservoir at a pressure less than the reservoir fracturing pressure and propagating forward combustion generally linearly toward a first of the production wells through a channel while producing said production well substantially unrestricted, to induce rapid advance of the combustion front through the channel;

(c) when there is indication at the first production well that heat breakthrough has been established between the injector and said first production well, then restricting the first production well before the combustion front arrives at said first production well;

(d) continuing to inject oxidizing gas through the injection well as before, with the first production well restricted, to induce rapid advance of the combustion front through another channel toward a second production well which is produced unrestricted;

(e) when there is indication at the second production well that heat breakthrough has been established between the injector and said second production well, then restricting the second production well before the combustion front arrives at said second production well;

(f) continuing to inject as before, with the production wells which have experienced heat breakthrough being restricted, to cause a significant pressure build-up in the network and surrounding reservoir to a pressure level which is less than the reservoir fracturing pressure;

(g) substantially terminating oxidizing gas injection through the injection well;

(h) injecting water through one of the wells to cool the burned channels;

(i) opening at least one of the aforesaid production wells to produce oil and blow down the reservoir thereby re-saturating the burned channels with oil; and (j) igniting the oil in the re-saturated channel and repeating steps (b) to (i) inclusive at least once.

2. The process as set forth in claim 1 comprising:

after step (e) and before step (f)

continuing to inject oxidizing gas through the injection well as before, with the first and second production wells restricted, to induce rapid advance of the combustion front down at least one more of the unburned channels toward a production well associated with each said channel, said production well(s) producing unrestricted, and to obtain a gradual increase in the injection pressure, and when there is indication at said production well(s) that heat breakthrough has been established between the injector and said production well(s), then restricting said production well(s) before the combustion front arrives at said production well(s).

3. A process for producing oil from a heavy oil reservoir in which pressure can be built up by injection of oxidizing gas and propagation of a combustion front, said reservoir having completed therein an injection well and a plurality of production wells, said reservoir having a network of generally linear, narrow, permeable channels interconnecting the wells, the reservoir otherwise being resistive to fluid injection, said process comprising:

(a) injecting oxidizing gas through the injection well and initiating combustion in the reservoir at the injection well;

(b) injecting oxidizing gas through the injection well into the reservoir at a pressure less than the reservoir fracturing pressure and propagating forward combustion generally linearly toward a first of the production wells through a channel while producing the production wells substantially unrestricted, to induce rapid advance of the combustion front through the channel;

(c) when there is indication at the first production well that heat breakthrough has been established between the injector and said first production well, then restricting the first production well before the combustion front arrives at said first production well;

(d) continuing to inject oxidizing gas through the injection well as before, with the first production well restricted and the remaining production wells being produced substantially unrestricted, to induce rapid advance of the combustion front through another channel toward a second of the production wells;

(e) when there is indication at the second production well that heat breakthrough has been established between the injector and said second production well, then restricting the second production well before the combustion front arrives at said second production well;

(f) repeating steps (d) and (e) for each remaining production well with the wells which have experienced heat breakthrough being restricted and the remaining production wells being substantially unrestricted, until all of the production wells in communication with the injection well have been restricted;

(g) continuing to inject as before with the production wells restricted, to cause a significant pressure build-up in the channel network ad surrounding reservoir to a pressure level which is less than the reservoir fracturing pressure;

(h) substantially terminating oxidizing gas injection through the injection well;

(i) injecting water through one of the wells to cool the burned channels;

(j) opening at least one of the production wells to produce oil and blown down the reservoir, thereby re-saturating the burned channels with oil; and (k) igniting the oil in the re-saturated channel and repeating steps (b) through (j) at least once.

4. The process as set forth in claim 1 comprising:

injecting water through the injection well either with the oxidizing gas or in alternating slugs therewith.

5. The process as set forth in claim 3 comprising:

injecting water through the injection well either with the oxidizing gas or in alternating slugs therewith.

6. The process as set forth in claim 1 comprising:

injecting sufficient water in step (h) to cool down the hot channel network to a temperature less than about 400° C.

7. The process as set forth in claim 2 comprising:

injecting sufficient water in step (i) to cool down the hot channel network to a temperature less than about 400° C.

8. A process for producing oil from a heavy oil reservoir in which pressure can be built up by injection of oxidizing gas and propagation of a combustion front, said reservoir having completed therein an injection well and a plurality of production wells, comprising:

(a) cyclically steam stimulating the wells to develop a network of generally linear, narrow, permeable fluid communication channels interconnecting the wells;

(b) injecting oxidizing gas through the injection well and initiating combustion in the reservoir at the injection well;

(c) injecting oxidizing gas through the injection well into the reservoir at a pressure less than the reservoir fracturing pressure and propagating forward combustion generally linearly toward a first of the production wells through a channel while producing the production wells substantially unrestricted, to induce rapid advance of the combustion front through the channel;

(d) when there is indication at the first production well that heat breakthrough has been established between the injector and said first production well, then restricting the first production well before the combustion front arrives at said first production well;

(e) continuing to inject oxidizing gas through the injection well as before, with the first production well restricted and the remaining production wells being produced substantially unrestricted, to induce rapid advance of the combustion front through another channel toward a second of the production wells;

(f) when there is indication at the second production well that heat breakthrough has been established between the injector and said second production well, then restricting the second production well before the combustion front arrives at said second production well;

(g) continuing to inject as before with the production wells restricted, to cause a significant pressure build-up in the channel network and surrounding reservoir to a pressure level which is less than the reservoir fracturing pressure;

(h) substantially terminating oxidizing gas injection through the injection well;

(i) injecting water through the injection well to cool the burned channels;

(j) opening at least one of the production wells to produce oil and blown down the reservoir thereby resaturating the burned channels with oil; and (k) igniting the oil in the re-saturated channel and repeating steps (c) to (j) inclusive at least once.

9. A process for producing oil from a heavy oil reservoir in which pressure can be built up by injection of oxidizing gas and propagation of a combustion front, said reservoir having completed therein an injection well and a plurality of production wells arranged in on-trend rows, comprising:

(a) cyclically steam stimulating the wells at fracturing pressure to develop a network of generally linear, narrow, fluid communication channels interconnecting the wells both in on-trend and off-trend directions;

(b) injecting oxidizing gas through the injection well and initiating combustion in the reservoir at the injection well;

(c) injecting oxidizing gas through the injection well into the reservoir at a pressure less than the reservoir fracturing pressure and propagating forward combustion generally linearly toward a first of the production wells through the channel while producing the production wells substantially unrestricted, to induce rapid advance of the combustion front through the channel;

(d) when there is indication at the first production well that heat breakthrough has been established between the injector and said first production well, then restricting the first production well before the combustion front arrives at said first production well;

(e) continuing to inject oxidizing gas through the injection well as before, with the first production well restricted and the remaining production wells being produced substantially unrestricted, to induce rapid advance of the combustion front through another channel toward a second of the production wells;

(f) when there is indication at the second production well that heat breakthrough has been established between the injector and said second production well, then restricting the second production well before the combustion front arrives at said second production well;

(g) repeating the steps of (e) and (f) for each remaining production well with the wells which have experienced heat breakthrough being restricted and the remaining production wells being unrestricted, until all of the production wells in communication with the injection well have been restricted;

(h) continuing to inject as before with the production wells restricted, until the injection pressure is close to the reservoir fracturing pressure;

(i) substantially terminating oxidizing gas injection through the injection well;

(j) injecting water through the injection well to cool the burned channels;

(k) opening at least one of the production wells to produce oil and blown down the reservoir thereby resaturating the burned channels with oil; and (l) igniting the oil in the re-saturated channel and repeating steps (c) through (k) at least once.

10. The process as set forth in claim 8 comprising:

injecting water through the injection well either with the oxidizing gas or in alternating slugs therewith.

11. The process as set forth in claim 9 comprising:

injecting water through the injection well either with the oxidizing gas or in alternating slugs therewith.

* * * * *

UNITED STATES PATENT AND TRADEMARK OFFICE

CERTIFICATE OF CORRECTION

PATENT NO. : 4,718,489

DATED : Jan. 12, 1988

INVENTOR(S) : Richard J. Hallam; John K. Donnelly

It is certified that error appears in the above—identified patent and that said Letters Patent is hereby corrected as shown below:

Column 19, line 35 - "(i)" should read "(h)"

Signed and Sealed this

Thirtieth Day of August, 1988

*Attest:*

*Attesting Officer*

DONALD J. QUIGG

*Commissioner of Patents and Trademarks*